US007650892B1

(12) United States Patent
Groves et al.

(10) Patent No.: US 7,650,892 B1
(45) Date of Patent: Jan. 26, 2010

(54) METHODS FOR HINDERING FORMATION OF TOBACCO-SPECIFIC NITROSAMINES

(75) Inventors: Lester E. Groves, Charlotte, TN (US); Robert H. Krauch, Memphis, TN (US); Harold J. Doss, Springfield, TN (US); Charles L. Vaught, Collierville, TN (US); John E. Bunch, Collierville, TN (US)

(73) Assignee: Rosswil LLC Ltd., Memphis, TN (US)

( * ) Notice: Subject to any disclaimer, the term of this patent is extended or adjusted under 35 U.S.C. 154(b) by 0 days.

(21) Appl. No.: 12/326,466

(22) Filed: Dec. 2, 2008

Related U.S. Application Data

(62) Division of application No. 10/934,576, filed on Sep. 3, 2004.

(51) Int. Cl.
*A24B 15/18* (2006.01)

(52) U.S. Cl. ..... 131/302; 131/308; 131/309

(58) Field of Classification Search ..... 131/296, 131/297, 299, 302, 308, 309
See application file for complete search history.

(56) References Cited

U.S. PATENT DOCUMENTS 4,267,645 A * 5/1981 Hill ..... 34/213
4,482,315 A * 11/1984 Day ..... 432/189
5,301,693 A * 4/1994 Chan et al. ..... 131/276
6,425,401 B1 * 7/2002 Williams ..... 131/303
7,404,406 B2 * 7/2008 Peele ..... 131/299
2005/0109357 A1 * 5/2005 Williams ..... 131/347

* cited by examiner

*Primary Examiner*—Carlos Lopez
(74) *Attorney, Agent, or Firm*—H. Roy Berkenstock; William S. Parks; Wyatt, Tarrant & Combs, LLP

(57) ABSTRACT

The present invention relates to methods for hindering formation of tobacco-specific nitrosamines during processing of dark fire tobacco, as well as a facility in which at least portions of these methods may be conducted. According to the present invention, dark fire tobacco that has been harvested and that is generally green and/or yellow is exposed to an uncontrolled, yet active, ambient airflow so as to provide a substantially aerobic environment about the tobacco. This exposure of the dark fire tobacco to the ambient airflow may be done until the tobacco is substantially brown and/or substantially free of enzymatic activity. Subsequently, the tobacco is exposed to gaseous emissions (e.g., smoke) from combusting sawdust/wood. This step may be conducted at least until the tobacco exhibits a moisture content of no more than about 16% and/or until the tobacco exhibits a gloss or shine on a surface of the tobacco.

59 Claims, 4 Drawing Sheets

FIGURE 2
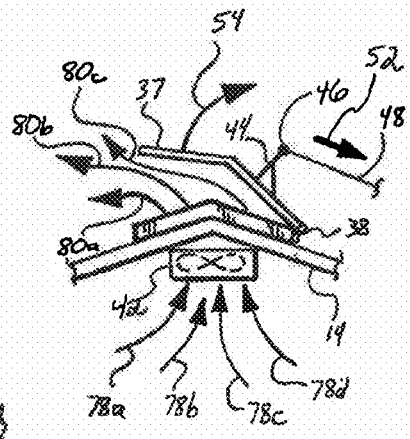
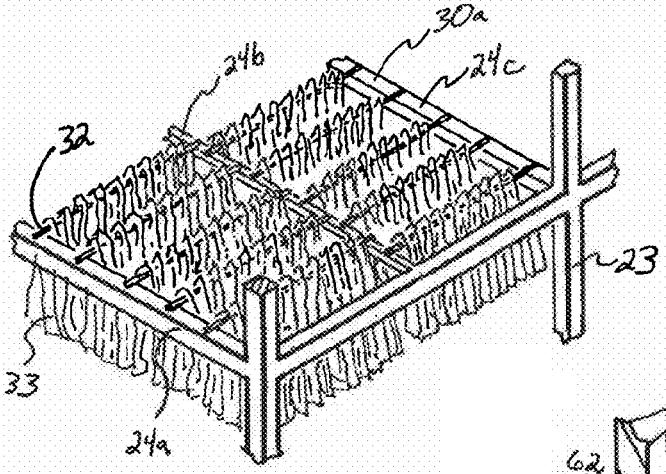
FIGURE 4
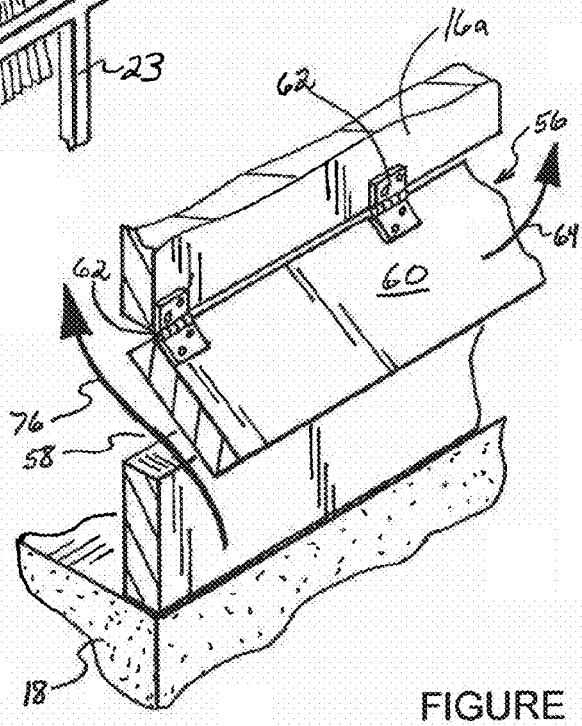
FIGURE 3
FIGURE 5
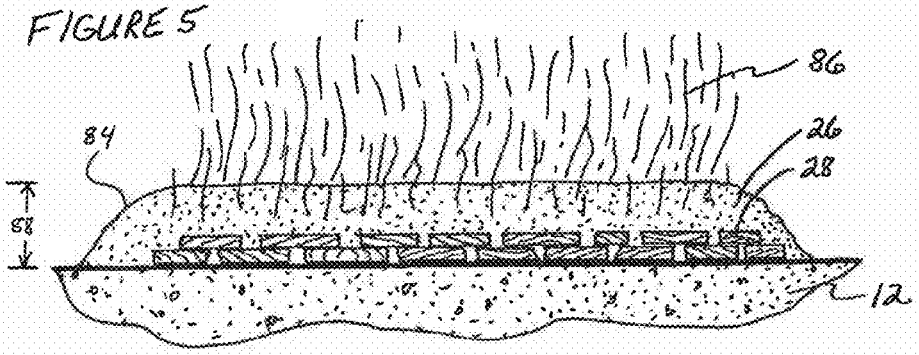

METHODS FOR HINDERING FORMATION OF TOBACCO-SPECIFIC NITROSAMINES

CORRELATED APPLICATION

This is a divisional filing from U.S. patent application Ser. No. 10/934,576, filed on Sep. 3, 2004, pending. Such parent application is referenced in full within this filing.

FIELD OF THE INVENTION

The present invention generally relates to tobacco products, and more particularly to methods for hindering formation of tobacco-specific nitrosamines in the manufacture of tobacco products and the products made thereby.

BACKGROUND OF THE INVENTION

In recent years, various attempts have been made to hinder, or ideally, substantially prevent formation of nitrosamines in tobacco products. Further, a number of attempts have been made to prevent exposing tobacco users to nitrosamines. For example, numerous filters have been employed in smoking tobacco products to at least generally attempt to filter out some of these nitrosamines. However, these efforts have not proved beneficial in smokeless tobacco products.

By way of introduction, fresh-cut, green tobacco has effectively no nitrosamines associated therewith. However, this fresh-cut, green tobacco is generally unsuitable for smoking and/or use in smokeless tobacco products such as chewing tobacco and/or snuff. In contrast, cured tobacco products manufactured in conventional manners are known to contain a number of tobacco-specific nitrosamines (TSNAs) such as N'-nitrosonornicotine (NNN), 4-(N-nitrosomethylamino)-1-(3-pyridyl)-1-butanone (NNK), N'-nitrosoanatabine (NAT), and N'-nitrosonoanabasine (NAB).

The above-mentioned TSNAs are believed to be formed at least generally post-harvest, such as during and/or after conventional curing processes. More particularly, it is believed that an amount of TSNAs in a cured tobacco plant is at least generally dependent upon a presence of nitrites that accumulate on the plant during senescence (e.g., process of aging from full maturity to death of the tobacco plant's cells). Moreover, these TSNAs are believed to be formed during curing at least in part due to a chemical reduction of nitrates facilitated or at least generally catalyzed by exposure of the tobacco to an at least generally anaerobic (oxygen deficient) environment. This reduction of nitrates to nitrites is believed to occur via metabolic processes of micro flora, and more particularly, microbial nitrate reductase activity, associated with the tobacco plant under at least generally anaerobic conditions. The existence of such an at least generally anaerobic condition around the tobacco plant may be fostered by the fact that tobacco plants typically emit carbon dioxide during at least part of the curing process. Indeed, the reduction of nitrates to nitrites has been found to be particularly pronounced under humid conditions in which it is believed that the increased humidity increases a microbial load on the plant. In any event, once these nitrites are formed, the same are believed to combine with various tobacco-associated alkaloids, such as certain pyridine-containing compounds, in a process known as "nitrosation" to form nitrosamines such as those mentioned above.

One conventional method of curing tobacco, known as "flue curing," at least generally involves placing tobacco plants, or at least the leaves thereof, in a curing barn and exposing the tobacco to convective heat in the form of one or more hot gaseous streams that includes combustion exhaust gases. When such convective heat is used to dry the tobacco, the combustion exhaust gases, such as carbon monoxide, carbon dioxide, oxides of nitrogen (e.g., $NO_x$), and water are introduced to and may even be said to pass at least generally through the tobacco. It has been shown that exposure of the tobacco to such combustion gases during curing may produce tobacco specific nitrosamines through reactions of tobacco alkaloids with alternative nitrosating agents.

Another conventional curing method includes a variation of a flue curing process in which a heat exchanger is utilized. More particularly, fuel is burned to heat air, and the heated air is passed through flue pipes into a curing barn in which the tobacco plants are disposed. This generally results in a flow of heated air that passes through the curing barn. Moreover, this process utilizes primarily radiant heat emanating from the flue pipes to heat the air, thus substantially preventing exposure of the tobacco to combustion exhaust gases during curing.

Still another conventional curing method known as "air curing" generally involves placing the harvested tobacco plants in a curing barn and subjecting the plants to ambient air curing. This curing method is typically accomplished with little or no governance of environmental conditions. However, it is known to at least generally regulate airflow to at least roughly affect temperature and/or humidity in the curing barn.

Yet still another conventional curing method relates to a specific group of tobacco cultivars known as "dark fire tobaccos." Typically, these dark fire tobaccos are harvested and hung in a curing barn while the leaves are yellow, green, or a combination thereof. A day or two after the tobacco is hung (and sometimes on the same day), the tobacco is exposed to heat and gaseous emissions (e.g., smoke) from combustion of appropriate materials such as wood and/or sawdust. This exposure is typically referred to as "dark firing" the tobacco and is generally done for several weeks. When the tobacco has reached a desired finish, the fire is extinguished, and the tobacco is allowed to come into order (or case) and subsequently removed from the barn for further processing. While the exposure of the tobacco to dark fire curing has traditionally been desirable to achieve a preferred flavoring of the tobacco, such conventional dark fire curing methods have not provided (or produced) tobacco products having reduced amounts of TSNAs.

SUMMARY OF THE INVENTION

Accordingly, it is an objective of the present invention to provide a method of treating harvested tobacco that hinders formation of TSNAs. More particularly, it is an object of the present invention to provide a method of hindering TSNA formation in dark fire tobacco. Relatedly, it is another object of the present invention to provide a method of treating tobacco that hinders nitrate reductase activity in harvested tobacco. Yet another object is to provide a method of treating tobacco that hinders TSNA formation yet allows for exposure of the tobacco to exhaust gases (e.g., smoke) for extended periods of time. Still another object is to provide a method of treating tobacco that provides a resultant dark fire tobacco product exhibiting a low TSNA content. These objectives, as well as others, may be met by the present invention described herein.

A first aspect of the invention is directed to a method of treating harvested tobacco that may at least generally be characterized as including both an ambient air treatment phase and a separate dark fire treatment phase. More particularly, when the tobacco is green, yellow, or a combination thereof, the tobacco is exposed to an ambient airflow substantially devoid of combustion emissions at least until the tobacco is substantially brown. Then, the tobacco is exposed to gaseous emissions from the burning of at least one carbonaceous material, such as wood and/or sawdust.

Exposing the tobacco to the above-noted ambient airflow may be said to provide a substantially aerobic environment about the tobacco. In one characterization, this ambient airflow may be said to provide a sufficient amount of oxygen to and/or about the tobacco to substantially prevent metabolic activity of at least one anaerobic microorganism (e.g., those capable of microbial nitrate reductase activity) associated with the tobacco. In another characterization, the above-described ambient airflow may be said to provide enough oxygen to and/or about the tobacco to hinder or even substantially prevent formation of at least one tobacco-specific nitrosamine. Indeed, the lack of combustion emissions in this ambient airflow may be characterized as airflow that is free of smoke generated from the burning of wood.

The color-change of the tobacco from green and/or yellow to brown may be attributed to a drying of the tobacco. For instance, in one embodiment, the moisture content of the tobacco may be reduced to no more than about 35% using the ambient airflow. In another embodiment, the moisture content of the tobacco may be reduced to between about 17% and about 35%. Upon drying the tobacco to the desired moisture content, and prior to exposure to any combustion emissions, the tobacco may exhibit a dry nitrosamine content of no more than about 5 ppm, preferably no more than about 4 ppm, more preferably no more than about 3 ppm, and still more preferably no more than about 2 ppm.

Exposing the tobacco to combustion emissions is preferably accompanied by an increase in temperature (relative to the air curing phase of the method) in the environment in which the tobacco is located. As such, this exposure of the tobacco to combustion exhaust gases may be said to facilitate a further drying of the tobacco. In one embodiment, employment of the combustion exhaust gases may result in reducing the moisture content of the tobacco to no more than about 16%. In another embodiment, the moisture content of the tobacco may be reduced to between about 12% and about 16% as a result of this exposure to combustion exhaust gases. After exposing the tobacco to the combustion exhaust gases and drying the tobacco to the desired moisture content, the tobacco may exhibit a dry nitrosamine content of no more than about 10 ppm, preferably no more than about 8 ppm, more preferably no more than about 6 ppm, and still more preferably no more than about 5 ppm. Indeed, in some embodiments, the tobacco may exhibit a lower dry nitrosamine content after exposure to the combustion exhaust gases than the tobacco did after exposure to the ambient airflow and prior to the exposure to the combustion exhaust gases.

After the tobacco has been exposed to combustion exhaust gases, the tobacco may again be exposed to ambient airflow. This subsequent exposure to ambient airflow may be for any appropriate amount of time. For example, in one embodiment, this second exposure to ambient airflow may occur for a time sufficient to increase a moisture content of the tobacco (relative to a moisture content of the tobacco upon completion of the exposing the same to the combustion exhaust gases). Due to this "re-exposure" of the tobacco to an ambient airflow, the tobacco may resultantly exhibit a moisture content of between about 20% and about 25%. In some embodiments, re-exposing the tobacco to the ambient airflow may be characterized as allowing the tobacco come into order or case.

In some embodiments, the application of nitrogen-containing fertilizer to the tobacco (and/or the ground on which the tobacco grows) is avoided for at least some period prior to a harvesting of the tobacco. This may be said to reduce the amount of nitrates associated with the tobacco after harvest. In other embodiments, fertilizers containing low levels of nitrogen may be utilized to facilitate growth of the tobacco. An example of an appropriate fertilizer having a low level of nitrogen would be one that, when spread according to the manufacturer's guidelines, includes no more than about 200 pounds of actual nitrogen per acre. Use of this type of fertilizer may also reduce the amount of nitrates associated with the tobacco after harvest (relative to tobacco plants grown with the use of fertilizer exhibiting higher levels of nitrogen content).

In the case where fertilizer exhibiting a low level of nitrogen content is utilized, the tobacco may have a moisture content of no more than about 26% after sufficient exposure to the ambient airflow and prior to exposure to the combustion exhaust gases. When the tobacco exhibits such a moisture content, the tobacco may exhibit a dry nitrosamine content of no more than about 3 ppm, preferably no more than about 2 ppm, and more preferably no more than about 1 ppm. Upon completion of exposing the tobacco to combustion exhaust gases for a sufficient time, and upon allowing the tobacco to come into order, the tobacco may exhibit a moisture content of between about 17% and about 26%. Exposure to the combustion exhaust gases tends to further reduce the moisture content of the tobacco. Accordingly, after such exposure to the combustion exhaust gases, the tobacco may exhibit a moisture content of no more than about 17%, and preferably between about 12% and about 17%. After sufficient exposure to the combustion exhaust gases, this tobacco may exhibit a dry nitrosamine content of no more than about 4 ppm, preferably no more than about 3 ppm, more preferably no more than about 2 ppm, yet more preferably no more than about 1 ppm, and even more preferably no more than about 0.75 ppm.

A second aspect of the invention is also directed to a method of treating tobacco. In this second aspect, tobacco that has been harvested and that includes an initial moisture content of no less than about 70% is exposed to an airflow that is substantially devoid of smoke at least until the tobacco includes a moisture content of no more than about 35%. Subsequently, the tobacco is exposed to smoke from smoldering carbonaceous material (e.g., wood and sawdust) at least until the tobacco exhibits a moisture content of no more than about 16%.

The exposure of the tobacco to airflow that is substantially devoid of smoke may be said to hinder formation of tobacco-specific nitrosamine(s) and/or hinder metabolic activity of one or more anaerobic microorganisms. This is accomplished, at least in part, due to the substantially smoke-free airflow providing an aerobic condition about the tobacco. An example of a suitable aerobic condition is an environment having an gaseous oxygen concentration of at least about 20%.

A third aspect of the invention is directed to a method of treating tobacco in which tobacco that has been harvested is exposed to an airflow sufficient to provide an aerobic condition about the tobacco when it is initially green and/or yellow at least until the tobacco is substantially brown. The tobacco exhibits a first dry nitrosamine content upon conclusion of this step. Subsequently, the tobacco is exposed to gaseous emissions from a burning of at least one carbonaceous material. The tobacco exhibits a second dry nitrosamine content upon completion of this step that is less than, substantially equal to, or not significantly greater than the first dry nitrosamine content.

Yet a fourth aspect of the invention is directed to a method of treating tobacco in which the tobacco that has been harvested and that is generally green and/or yellow upon initiation of this step is exposed to an airflow sufficient to provide an aerobic condition about the tobacco for at least about 27 days (e.g., between about 27 days and about 61 days). Subsequently, the tobacco is exposed to exhaust gases from combustion of at least one carbonaceous material for at least about 25 days (e.g., between about 25 days and about 50 days).

Still a fifth aspect of the invention is directed to a method of treating tobacco in which the tobacco that has been harvested and that is generally green and/or yellow upon initiation of this step is exposed to an airflow sufficient to provide an aerobic condition about the tobacco until the tobacco is substantially free of enzymatic activity. Subsequently, the tobacco is exposed to emissions from a burning of carbonaceous material at least until a surface of the tobacco includes a gloss or shine. This gloss or shine may be said to be attributable to an accumulation of phenols on the surface of the tobacco.

In yet a sixth aspect, the present invention is directed to a tobacco product precursor. Herein, a "tobacco product precursor" generally refers to tobacco that has been harvested and treated in accordance with the present invention, yet prior to a stage at which the tobacco is packaged and/or distributed for human consumption (e.g., smoking, chewing, snorting, or the like). The tobacco product precursor generally includes at least a portion of a tobacco leaf that is substantially brown and that includes a plurality of phenols on an outer surface thereof. In addition, this tobacco product precursor generally exhibits a dry nitrosamine content of no more than about 5 ppm, preferably no more than about 4 ppm, and more preferably no more than about 3 ppm. Indeed, in some embodiments, the tobacco product precursor may exhibit a dry nitrosamine content of no more than about 2 ppm.

Still a seventh aspect of the invention is directed to a tobacco product precursor including at least a portion of a dark fire tobacco leaf. The dark fire tobacco of this tobacco product precursor is substantially brown and exhibits a dry nitrosamine content of no more than about 2 ppm.

The tobacco product precursor may include tobacco exhibiting any number of appropriate combinations of moisture content and dry nitrosamine content. For instance, some embodiments may exhibit a moisture content of between about 20% and about 27% and/or a dry nitrosamine content of no more than about 1.5 ppm. Other embodiments may have a moisture content of between about 20% and about 26% and/or a dry nitrosamine content of no more than about 0.9 ppm. Still other embodiments may exhibit a moisture content of between about 17% and about 26% and/or a dry nitrosamine content of no more than about 0.8 ppm. Yet other embodiments may have a moisture content of between about 12% and about 18% and/or a dry nitrosamine content of no more than about 2 ppm.

Various other features and refinements may exist of in relation to the above-disclosed aspects of the present invention. These other refinements and features may exist individually or in any combination. Moreover, each of the various refinements and features discussed herein in relation to one or more of the disclosed aspects of the present invention may generally be utilized by any other aspect(s) of the present invention as well, alone or in any combination.

BRIEF DESCRIPTION OF THE DRAWINGS

FIG. 2 is an elevation view of a roof vent associated with the curing barn of FIG. 1.

FIG. 3 is a magnified perspective view of a wall vent associated with the curing barn of FIG. 1.

FIG. 4 is a perspective view of tobacco hanging on sticks that are supported by beams of the curing barn of FIG. 1.

FIG. 5 is cross-section view of a floor of the curing barn of FIG. 1 having smoldering wood and sawdust disposed thereon.

DETAILED DESCRIPTION OF THE DRAWINGS

The present invention will now be described in relation to the accompanying drawings, which at least assist in illustrating the various pertinent features thereof. A number of appropriate structures (e.g., buildings) may be utilized to accomplish one or more of the tobacco treatment processes described herein. Accordingly, various aspects of the invention may be realized utilizing structures exhibiting various shapes, sizes, dimensions, and componential make-ups. For example, FIG. 1 illustrates a curing barn 10 in which at least portions of one or more of the curing processes described herein may be carried out.

Figure 1:
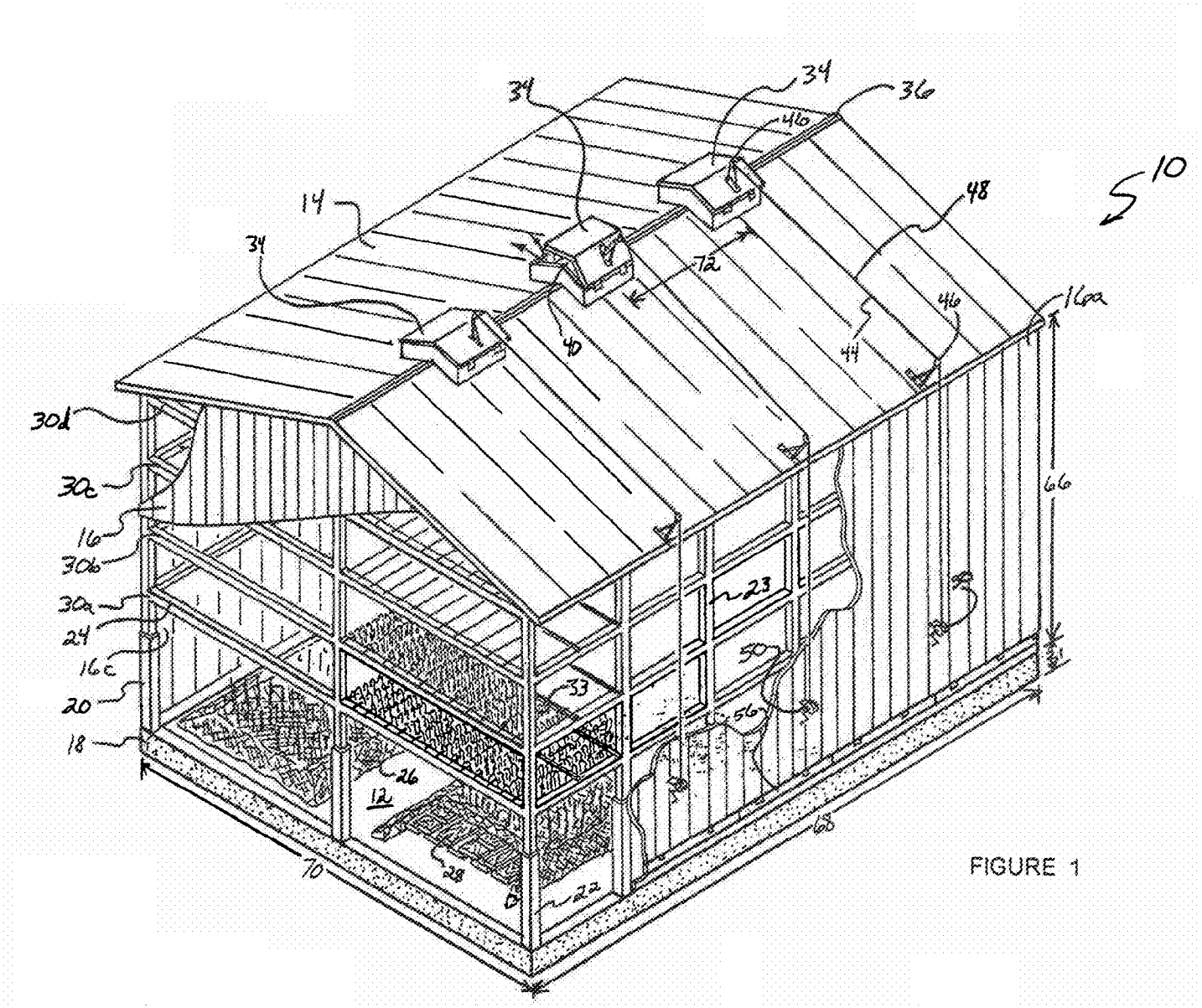
FIG. 1 is a cut-away perspective view of a curing barn.

FIG. 1 illustrates the curing barn 10 having a floor 12, a roof 14, and a plurality of walls 16. The floor 12 of this curing barn 10 may be any of a number of appropriate surfaces. It is generally preferred that the floor 12 exhibit a general combustion-resistance. Accordingly, it is preferred that the floor 12 be the ground or constructed of concrete or the like. The roof 14 and the walls 16 may be constructed of any appropriate materials. Again, since lower portions of the walls 16 are generally exposed to combustion and/or significant heat during at least portions of the curing processes described herein, it is generally preferred that at least the lower portions of the walls 16 be constructed of a combustion resistant material. For instance, the walls 16 of the curing barn 10 may be made of a sheet metal. The roof 14 of the curing barn 10 is also made of sheet metal. While the roof 14 and the walls 16 of the curing barn 10 are described as being constructed of the same material, other embodiments may exhibit an appropriate curing structure in which the walls and roof are made of different materials. Incidentally, various dimensions of the curing barn 10 may be suitable. For example, in this particular embodiment, the curing barn 10 exhibits a length 68 of about 40 feet and a width 70 of about 30 feet. Further, a height 66 of walls 16*a* and 16*c* is about 20 feet.

The curing barn 10 of FIG. 1 includes a foundation 18 that is interconnected with and/or supports a frame 20 of the curing barn 10. This foundation 18 may be made of any appropriate material. For instance, the foundation 18 may be made of concrete, mason block, and/or the like. Since the foundation 18 is generally exposed to heat from combustion, for example, of sawdust 26 and wood 28, it is generally preferred that the foundation 18 be made of combustion resistant material like those mentioned above. Further, this foundation 18 may exhibit any appropriate dimensions. In FIG. 1, the foundation 18 has a height 21 of about 2 feet. In other words, the foundation 18 extends out (or up) from the floor 12 by distance of about 2 feet. At least in one embodiment, it may be said that this foundation 18 provides a benefit of at least generally providing a spacing or separation between any combustible component(s) of the frame 20 and the wood 28 and sawdust 26 combusting on the floor 12 of the curing barn 10.

The frame 20 to which the walls 16 and the roof 14 of the curing barn 10 of FIG. 1 are interconnected may be any appropriate frame structure. In this case, the frame 20 includes combustion resistant (e.g., metal, concrete, or the like) posts 22, wooden posts 23, and wooden beams 24. More particularly, the combustion resistant posts 22 are supported by, interconnected with, or even integral with the foundation 18. Atop of and/or interconnected with each of these posts 22 is a wooden post 23 to which a number of wooden beams 24 are interconnected. Any manners of fastening the beams 24 and the posts 23 to one another may be appropriate. As shown, the beams 24 are connected with the posts 23 in a fashion such that the frame 20 includes a plurality of levels 30 (e.g., first, second, third, and fourth levels 30*a-d*, respectively). While any of a number of appropriate spacings between adjacent levels (e.g., 30*a* and 30*b*) may exist, the frame 20 exhibits a spacing 25 of about 4 feet between adjacent levels. Sticks 32 from which tobacco 33 is suspended may be supported by adjacent beams 24 associated with each of these levels 30 (see FIG. 4). The tobacco 33 may be disposed on these sticks 32 in any appropriate fashion, and, likewise, the sticks 32 may be supported by the beams 24 in any appropriate fashion. For instance, each of the sticks 32 may extend or pass through one or more tobacco stalks and/or leaves, and referring to FIG. 4, ends of each stick 32 may be supported by beams 24*a* and 24*b* or by beams 24*b* and 24*c*. Incidentally, these sticks 32 may be made of any appropriate material such as wood, plastic, metal, or the like. Moreover, a variety of appropriate quantities of tobacco may be associated with each stick. For instance, each stick may extend through the stalks of, and thereby support, about six harvested tobacco plants.

Referring to FIGS. 1-2, a plurality of (here, three) roof vents 34 are associated with the roof 14 of the curing barn 10. More particularly, these roof vents 34 are located at a peak 36 of the roof 14. Other curing structures may include one or more roof vents that are not located at a peak of the corresponding roof (if the roof even has a peak). Further, while adjacent roof vents 34 may be separated by any appropriate distance, the spacing 72 between adjacent roof vents 34 (from a portion of one to a corresponding portion of another) of the curing barn 10 is generally about 10 feet. Referring to FIG. 2, each of these roof vents 34 includes a door 37 that is pivotally interconnected (e.g., via a hinge 38 or the like) with the roof 14 of the curing barn 10. The pivotal movement relationship of this door 37 of the roof vent 34 relative to the roof 14 enables an aperture 40 (FIG. 1) of the roof vent 34 to be exhibit various degrees of occlusion and/or obstruction as desired. In other words, the door 37 may be opened as far as desired or disposed in a substantially closed condition. While the aperture 40 (and thus, the corresponding door 37) of each roof vent 34 may be any appropriate size, the aperture 40 in FIG. 1 is generally about 4 feet by about 4 feet.

Another component of the roof vent 34 shown in FIG. 2 is a fan assembly 42. This fan assembly 42 is interconnected with the roof 14 of the curing barn 10 and may be any appropriate fan assembly 42. For instance, the fan assembly 42 utilized in the curing barn 10 may be an appropriate Dayton model exhaust fan manufactured by Emerson Ventilation Products of Lenexa, Kans. Moreover, the fan assembly 42 may exhibit any appropriate specifications. For example, the fan assembly 42 may exhibit a diameter of about 36 inches, a power of about 1.5 horsepower (hp), and/or an output of about 16,160 cubic feet per minute (CFM). It should be noted that other appropriate curing structures may have one or more roof vents that do not include a fan assembly. Further, some curing structures may be equipped with one or more fan assemblies that are not associated with a roof vent.

Still referring to FIGS. 1-2, interconnected with the door 37 of each roof vent 34 is a control assembly 44. This control assembly 44 generally includes one or more pulleys 46, a cable 48, and a winch 50. More particularly, one end of the cable 48 is interconnected with the door 37 of the roof vent 34, and another end of the cable 48 is interconnected with or wrapped about the winch 50. In at least one embodiment, it may be said that the pulley(s) 46 is utilized to at least generally prevent contact (e.g., rubbing) of the cable 48 with the roof 14 and/or the wall 16 of the curing barn 10. While the cable 48 may be any appropriate cable, rope, or the like, the illustrated cable 48 is stainless steel cable having a diameter of about 0.25 inch. Further, while the winch 50 is shown as being manually operatable (e.g., having a hand crank), a number of other manual, pneumatic, hydraulic, and/or electronic winches may be utilized in this and/or other embodiments of the curing barn 10. In addition, this winch 50 is shown as being interconnected with the wall 16*a* of the curing barn 10. However, other embodiments may exhibit other appropriate locations for the winch 50.

To open the roof vent 34, the winch 50 is turned in a direction to draw more (or at least some) of the cable 48 about the winch 50. As seen in FIG. 2, this turning of the winch 50 causes the cable 48 to be pulled in the direction indicated by arrow 52 causing the door 37 to be pivoted about the hinge 38 in the direction indicated by arrow 54. Incidentally, the door 37 is shown in an open condition in FIG. 2. It should be noted that the open condition of the door 37 in FIG. 2 is to a degree that it at least generally prevents precipitation (e.g., rain) from entering the curing barn 10 via the aperture 40 of the roof vent 34.

To close the roof vent 34, the winch 50 is turned in a direction to let out the cable 48 from about the winch 50. This turning of the winch 50 causes the cable 48 to at least generally move in a direction substantially opposite that indicated by the arrow 52 causing the door 37 to be pivoted about the hinge 38 in a direction substantially opposite that indicated by the arrow 54. Accordingly, a degree of occlusion and/or unobstruction of the aperture 40 of the roof vent 34 (via opening and closing the door 37) may be controlled utilizing the control assembly 44. Incidentally, other embodiments may include other appropriate control assemblies for opening and/or closing one or more doors associated with a roof vent.

Turning to FIGS. 1 and 3, associated with at least one wall 16, and here, two opposing walls 16*a* and 16*c*, are a plurality of wall vents 56. These wall vents 56 may be found at a number of appropriate locations along the walls 16 of the curing barn 10. However, it is generally preferred that the wall vents 56 are disposed toward the floor 12, yet above the foundation 18, of the curing barn 10. While the wall vents 56 may exhibit any of a number of appropriate designs/configurations, each of the wall vents 56 generally includes an airflow passage 58 and a door 60 that is pivotally interconnected (e.g., via one or more hinges 62) with the corresponding wall 16 of the curing barn 10. Each of these doors 60 may be made of any appropriate material. However, here, the doors 60 are 2×6 inch (width by thickness) pieces of wood of any appropriate length.

To open one of the wall vents 56, the door 60 may be pivoted about the hinge(s) 62 and relative to the wall 16 in the direction indicated by arrow 64 (FIG. 3). To maintain an open position of the door 60, an object (a brick, stick, etc.) may be utilized to prop the door 60 open. Alternatively, a chain that is attached to the wall 16 may be releasably connected to the door 60 to hold the door 60 open. By contrast, to close the wall vent 56, the object utilized to prop the door 60 open may be removed, and the door 60 may be pivoted about the hinge(s) 62 and relative to the wall 16 in a direction substantially opposite that indicated by the arrow 64. In embodiments utilizing a chain to keep the doors 60 open, the chain may be disconnected from the door 60, and the door 60 may be allowed to pivot about the hinge(s) 62 and relative to the wall 16 in a direction substantially opposite that indicated by the arrow 64. Other embodiments may exhibit other appropriate manners (e.g., manual and/or electronic) of opening and closing a wall vent. Incidentally, while the door 60 of the wall vent 56 is in an open condition in FIG. 3, it should be noted the open condition of the door 60 is such that it at least generally prevents precipitation (e.g., rain) from entering the curing barn 10 via the airflow passage 58 of the wall vent 56.

Figure 6:
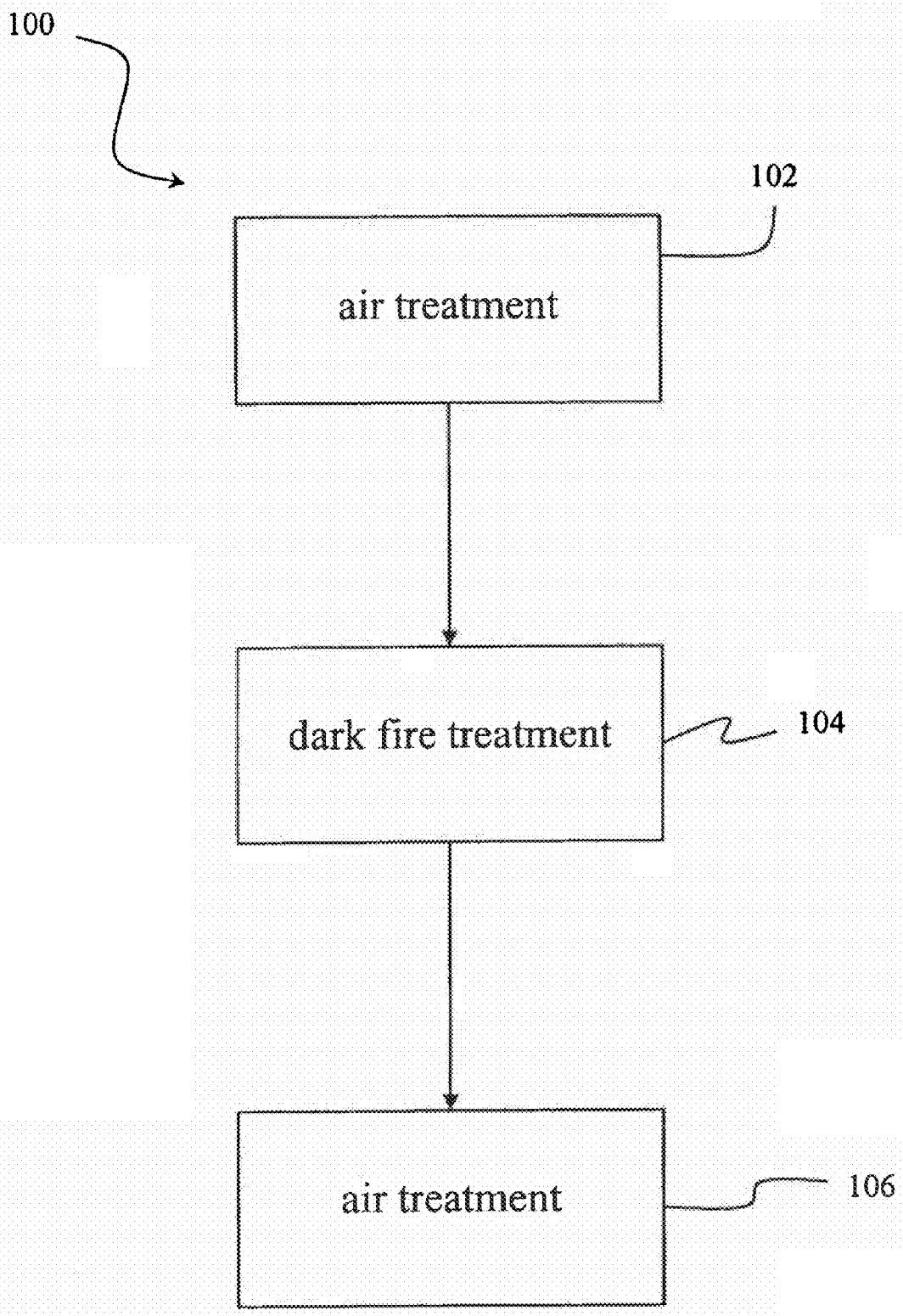
FIG. 6 is a flowchart illustrating a curing protocol of the invention.

While a number of tobacco varieties may be treated utilizing the curing barn 10, the curing barn 10 is preferably constructed to accommodate the curing of dark fire tobacco. Herein, "dark fire" tobacco refers to tobacco varieties that are generally exposed to smoke and/or exhaust gases from burning/smoldering carbonaceous material during a curing of the tobacco. Examples of dark fire tobaccos include Narrow Leaf Madole, Improved Madole, Tom Rosson Madole, Newton's VH Madole, Little Crittenden, Green Wood, Little Wood, Small Stalk Black Mammoth, DT 508, DT 518, DT 592, KY 171, DF 911, DF 485, TN D94, TN D950, VA 309, and VA 359. While the exemplary tobacco curing protocol 100 of FIG. 6 is specifically directed to the curing of dark fire tobacco, the curing protocol 100 may have application with other tobacco varieties as well. Further, while the curing barn 10 is utilized in the following description to facilitate understanding of the curing protocol 100, the following curing protocol 100 may be accomplished utilizing any of a number of other appropriate curing/treatment structures.

After the dark fire tobacco 33 has been harvested, it is preferably placed on the sticks 32 while in a substantially green condition. In other words, the dark fire tobacco 33 may exhibit some yellowness, but is preferably significantly more green than yellow. The sticks 32, having the tobacco 33 suspended therefrom, are then placed in the curing barn 10. More particularly, the sticks 32 are placed so that they are supported by the beams 24 of the curing barn 10. Incidentally, for time efficiency and ease of loading, it is generally preferred that the curing barn 10 be loaded with the sticks 32 from the top down. In other words, a desired number of the sticks 32 having tobacco 33 suspended therefrom are placed on the fourth level 30*d* of the curing barn 10 before the third, second, and first levels 30*a-c* are loaded. Incidentally, while not illustrated on the curing barn 10 of FIG. 1, the curing barn 10 is generally equipped with at least one access door (that may be any of a number of appropriate doors) to enable at least human access in and out of the curing barn 10, for example, during loading and/or unloading of the barn 10.

The curing protocol 100 of FIG. 6 includes both an air treatment step 102 and a separate and distinct dark fire treatment step 104. Indeed, the air treatment step 102 may be characterized as a substantially aerobic stage of the curing protocol 100, and the dark fire treatment step 104 may be a stage of the curing protocol 100 characterized by a presence of a significant amount of combustion exhaust gases.

With regard to the air treatment step 102, after the tobacco 33 has been loaded into the curing barn 10, the tobacco 33 is exposed to an ambient airflow substantially devoid of combustion exhaust gases. Referring to FIGS. 1-3, during this air treatment step 102 of the curing protocol 100, the roof vents 34 and the wall vents 56 are preferably open (at least to some degree). In addition, the fan assembly 42 of each corresponding roof vent 34 is preferably on throughout the entirety of the air treatment step 102. However, other embodiments of the air treatment step 102 may not include having the fan assemblies 42 on throughout the entirety of that step 102.

Having the fan assemblies 42 of the curing barn 10 on while the vents 34, 56 are open causes air to at least generally be drawn into the curing barn 10 (as indicated by arrow 76 of FIG. 3) via the airflow passages 58 of the wall vents 56. Upon entering the curing barn 10 by way of the airflow passages 58 of the wall vents 56, the air preferably flows about the tobacco 33 and (at some point) at least generally toward at least one of the roof vents 34. The fan assemblies 42 at least generally assist in directing airflow toward the fan assemblies 42 as indicated by arrows 78*a-d* of FIG. 2. The fan assemblies 42 may also be said to assist in directing airflow out of the curing barn 10 (as indicated by arrows 80*a-c*) via the aperture 40 of each corresponding roof vent 34. Other manners and/or directions of airflow may be appropriate as well.

Another embodiment of the air treatment step 102 of the protocol 100 of FIG. 6 includes having the fan assemblies 42 on for a portion of each day of that step 102 and off for a portion of each day of that step 102. More particularly, the fan assemblies 42 may be on during at least some of the daytime hours and off during at least some of the nighttime hours. For instance, for every 24 hour period, the fan assemblies 42 may be on from about 10 AM to about 10 PM and off from about 10 PM to about 10 AM the next day. Other patterns and durations of having the fan assemblies 42 on and off may also be appropriate. A reason for this alternation of having the fan assemblies 42 on and off is that ozone ($O_3$) levels in the atmosphere tend to rise and fall over a 24-hour period. In other words, it is generally beneficial to increase the airflow through the curing barn 10 when atmospheric ozone levels are higher and to decrease the airflow through the curing barn 10 when ozone levels are lower.

Figure 7:
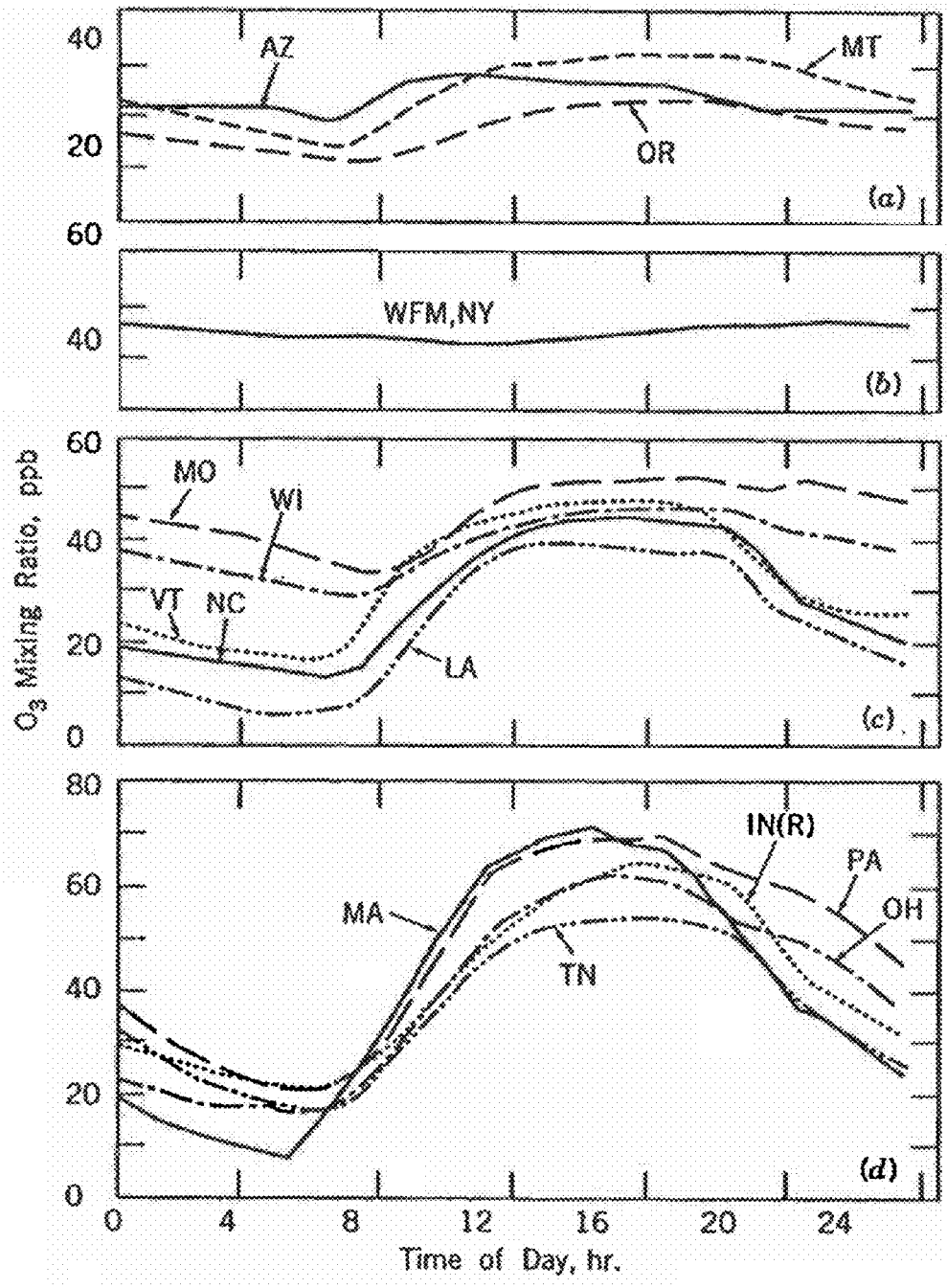
FIG. 7 is a graph illustrating atmospheric ozone content at various geographic locations during a 24-hour period.

Referring to FIG. 7, the ozone content of the atmosphere tends to be greatest between the hours of about 11 AM and about 7 PM. Likewise, the amount of ozone in the atmosphere tends to be lowest between about 12 AM and about 9 AM. Indeed, it has been found that increasing airflow through the curing barn 10 during periods of high atmospheric ozone content and decreasing airflow through the curing barn 10 during periods of low atmospheric ozone content has a significant affect on hindering TSNA formation. Accordingly, in one embodiment, the fan assemblies 42 may be on facilitating an active airflow in the curing barn 10 when atmospheric ozone levels are at least about 50 ppb (parts per billion) and off allowing a passive airflow in the curing barn 10 when atmospheric ozone levels are at most about 25 ppb. In another embodiment, the fan assemblies 42 may be on facilitating an active airflow in the curing barn 10 when atmospheric ozone levels are at least about 45 ppb and off allowing a passive airflow in the curing barn 10 when atmospheric ozone levels are at most about 30 ppb. In still another embodiment, the fan assemblies 42 may be on facilitating an active airflow in the curing barn 10 when atmospheric ozone levels are at least about 40 ppb and off allowing a passive airflow in the curing barn 10 when atmospheric ozone levels are at most about 35 ppb.

From a generally vertical standpoint, the wall vents 56 shown in FIG. 1 are preferably disposed below the lowest hanging tobacco 33 of the first level 30*a* of the curing barn 10.

This generally enhances the likelihood of providing a sufficient ambient airflow about the tobacco 33 associated with all four levels 30*a-d* of the curing barn 10 to promote the desired substantially aerobic condition. In some embodiments of the invention, the rate (and/or other parameters such as temperature and humidity content) of airflow through the curing barn 10 may be controlled. However, with regard to the curing barn 10 of FIG. 1, the airflow may be said to be uncontrolled. A better characterization may be to say that the curing barn 10 has an active (compared to a passive) airflow therein. That is, the fan assemblies 42 function to draw air into the curing barn 10 (via the airflow passages 58), to facilitate airflow within the curing barn 10, and to promote airflow out of the curing barn 10 (via the apertures 40 of the roof vents 34). However, the airflow within the curing barn 10 may be said to be uncontrolled since the airflow is generally subject to wind conditions. In other words, even though the conditions of the vents 56, 34 and the fan assemblies 42 may remain substantially the same from one day to the next, the airflow within the curing barn 10 may change from one day to the next (as well as during any given day) simply due to outside weather conditions. Further, some airflow both enters and exits the curing barn 10 via one or more of the wall vents 56. Still further, since the curing barn 10 is not constructed in an air tight fashion, airflow may enter and or exit the curing barn 10 via cracks and/or gaps (e.g., in the walls and/or roof) of the curing barn 10. Yet further, airflow at one location within the curing barn 10 may significantly differ from airflow at another location within the curing barn 10. It should be noted that some embodiments of the invention may employ curing structures in which only passive airflows (e.g., no fan assemblies or the like) are utilized in this air treatment step 102 of the curing protocol 100.

Exposing the dark fire tobacco 33 to this ambient airflow may be said to provide a substantially aerobic condition about the tobacco 33. This ambient airflow may be said to provide a sufficient amount of oxygen to and/or about the tobacco 33 to substantially prevent metabolic activity of at least one anaerobic microorganism (e.g., those capable of microbial nitrate reductase activity) associated with the tobacco 33 and/or to hinder or even substantially prevent formation of at least one tobacco-specific nitrosamine. Indeed, the lack of combustion exhaust gases in this ambient airflow may be characterized as airflow that is free of smoke generated from the burning of carbonaceous material (e.g., wood and/or sawdust).

The air treatment step 102 of the curing protocol 100 of FIG. 6 is preferably conducted until the tobacco 33 changes from a green and/or yellow color to a brown color. This change in color is generally attributed to a drying of the tobacco 33. Indeed, when this air treatment step 102 is initiated, the tobacco 33 preferably exhibits a moisture content of no more than about 70%. Further, the air treatment step 102 is generally concluded when the moisture content of the tobacco is reduced to no more than about 35%, and preferably between about 17% and about 35%.

The air treatment step 102 of the curing protocol 100 may last for any appropriate duration of time. It is generally preferred that the air treatment step 102 be at least about 27 days in duration, and more preferably between about 27 days and about 61 days in duration. It should be noted, however, that other embodiments may exhibit other appropriate durations for this air treatment step 102. Factors such as weather conditions (e.g., temperature, humidity, wind, and the like) outside the curing barn 10 may affect the duration of this air treatment step 102 of the protocol 100. In any event, upon completion of this air treatment step 102, the tobacco 33 is preferably substantially free of enzymatic activity. Moreover, the tobacco 33 preferably exhibits a dry nitrosamine content of no more than about 5 ppm (parts per million), more preferably no more than about 4 ppm, still more preferably no more than about 3 ppm, and yet more preferably no more than about 2 ppm.

Subsequent to the above-described air treatment step 102 of the protocol 100, a low-burning or smoldering fire is generally provided under the tobacco 33. The provision of this low-burning fire, and, more importantly, the exposure of the tobacco 33 to combustion exhaust gases 86 (FIG. 5) emitted therefrom is referred to as the dark fire treatment step 104 of the curing protocol 100 of FIG. 6. Referring to FIGS. 1 and 5, a mound 84 of carbonaceous material that is disposed on the floor 12 of the curing barn 10 is ignited to emit these combustion exhaust gases 86 (e.g., smoke). In this case, the mound 84 includes wood 28 and sawdust 26. It is generally preferred that the wood 28 and sawdust 26 be of a hardwood-type such as one or more of oak, hickory, poplar, maple, and the like. In addition, in some cases, tree bark may also be included in the mound 84.

Still referring to FIGS. 1 and 5, it is generally preferred that a height 88 of the mound 84 be no greater than the distance from the floor 12 of the curing barn 10 to the lowest portion of each airflow passage 58 of the wall vents 56. Accordingly, in this embodiment, the height 88 of the mound 84 is generally no greater than the height 21 of the foundation 18 of the curing barn 10. This arrangement beneficially prevents undesirable flare ups of the low-burning fire associated with the mound 84. In other words, this arrangement is utilized to at least generally manage the burn (e.g., rate, temperature, intensity, and/or the like) of the fire. Incidentally, the roof vents 34 and the wall vents 56 of the curing barn 10 are preferably open (at least to some degree) during the dark fire treatment step 104 of the curing protocol 100. However, other embodiments of the dark fire treatment step 104 may include having one or more of the vents 34, 56 closed during at least a portion of that step 104. For instance, in the case that weather conditions include significant winds, it may be beneficial to close at least some of the wall vents 56 to prevent the fire from flaring up and igniting the curing barn 10. In addition, the fan assembly 42 of each corresponding roof vent 34 is preferably off throughout the entirety of the dark fire treatment step 104. However, other embodiments of the dark fire treatment step 104 may include having one or more of the fan assemblies 42 on throughout at least a portion of that step 104.

The dark fire treatment step 104 of the curing protocol 100 is generally characterized by an increase in temperature (relative to the air treatment step 102) within the curing barn 10 as well as a significant increase (relative to the air treatment step 102) in the presence of combustion exhaust gases 86 (e.g., carbon monoxide, nitrogen oxides ($NO_x$), and carbon dioxide) within the curing barn 10. Indeed, it is an objective of this dark fire treatment step 104 to expose the tobacco 33 to significant amounts of combustion exhaust gases 86. This is generally done for a variety of reasons. One reason may be to enhance the flavor of the resulting tobacco product. Another reason may be to deposit phenols on the tobacco 33. Still another reason may be to further dry the tobacco 33. As stated above, exposing the tobacco 33 to the combustion exhaust gases 86 is preferably accompanied by an increase in temperature in the curing barn 10 that generally results in a further drying of the tobacco 33. Indeed, the moisture content of the tobacco 33 is preferably reduced to no more than about 16% during this dark fire treatment step 104. For instance, the moisture content of the tobacco 33 may be reduced to between about 12% and about 16% due to this dark fire treatment step 104.

The dark fire treatment step 104 of the curing protocol 100 may last any appropriate amount of time. It is preferred that a duration of the dark fire treatment step 104 be at least about 25 days. For instance, in some embodiments, this dark fire treatment step 104 lasts between about 25 days and about 50 days. Further, it is generally preferred that the tobacco 33 be exposed to the combustion exhaust gases 86 at least until a surface of the tobacco 33 exhibits a gloss or shine. Again, this gloss or shine may be said to be attributable to an accumulation of phenols on the surface of the tobacco 33.

Upon completion of the dark fire treatment step 104 of the curing protocol 100, the tobacco 33 may exhibit a dry nitrosamine content of no more than about 10 ppm, preferably no more than about 8 ppm, more preferably no more than about 6 ppm, and still more preferably no more than about 5 ppm. Indeed, in some embodiments, the tobacco 33 may exhibit a dry nitrosamine content after the dark fire treatment step 104 that is lower than the tobacco 33 after the air treatment step 102 and prior to the dark fire treatment step 104.

In an optional, yet preferred, step of the curing protocol 100, the tobacco 33 may undergo another air treatment step 106 after the dark fire treatment step 104. This air treatment step 106 may last any appropriate duration of time. It is, however, preferred that this air treatment step 106 last for a time sufficient to increase a moisture content of the tobacco 33 (relative to a moisture content of the tobacco 33 upon completion of the dark fire treatment step 104). The roof vents 34 and the wall vents 56 of the curing barn 10 are preferably open during this air treatment step 106 of the curing protocol 100. In addition, each of the fan assemblies 42 of the corresponding roof vents 34 may be either on or off during the air treatment step 106.

Due to this "re-exposure" of the tobacco 33 to the ambient airflow of the air treatment step 106, the tobacco 33 preferably resultantly exhibits a moisture content of between about 20% and about 25%. This increase in moisture content of the tobacco 33 generally provides an added benefit of increased durability of the tobacco 33. For instance, the tobacco 33 generally tends to crack and/or break apart less at a moisture content of between about 20% and about 25% than comparable tobacco 33 exhibiting a moisture content less than about 20% (e.g., between about 12% and about 16%).

Upon completion of step 104 (or step 106 in at least some embodiments) of the protocol 100, the tobacco 33 may be referred to as a tobacco product precursor. Again, a "tobacco product precursor" generally refers to tobacco that has been harvested and treated in accordance with the present invention, yet has not been packaged and/or distributed for human consumption (e.g., smoking, chewing, snorting, or the like). Due, at least in part to the curing protocol 100, the tobacco product precursor preferably refers to at least a portion of a dark fire tobacco leaf that is substantially brown and that includes a plurality of phenols on an outer surface thereof. In addition, this tobacco product precursor generally exhibits a dry nitrosamine content of no more than about 2 ppm and a moisture content of between about 20% and about 27%.

Other treatments may enhance an effectiveness of the curing protocol 100. For instance, ascorbic acid treatment of the tobacco (e.g., such as by spraying a 1%, 5%, or 10 ascorbic acid solution on the tobacco) prior and/or subsequent to harvest may beneficially affect the resultant TSNA content of the tobacco cured using the curing protocol 100. As another example, pre-harvest treatment of the tobacco with an appropriate plant health regulator such as Messenger® manufactured by Eden Bioscience Corporation of Bothell, Wash., may also prove beneficial.

EXAMPLES

The following examples show test results under a variety of conditions. Reference to the curing barn 10 or a curing facility similar to the curing barn 10 may be made in the discussion of these results to facilitate understanding of the procedures that coincide with the particular test results. It should, however, be noted that these results may be achieved by employing curing processes of the invention in any of a number of other appropriate curing structures.

With regard to a first curing process, dark fire tobacco (more particularly, Narrow Leaf Madole tobacco) was harvested and, about two days later, housed in a curing barn. The curing barn used in this first curing process had a length (e.g., 68) of about 40 feet and a width (e.g., 70) of about 30 feet. Further, the curing barn had four tiers (e.g., 30*a-d*), and the tobacco inside the barn was divided into twenty samples of about two or three leaves. Incidentally, each of these samples included tobacco from each of the four tiers of the curing barn. Still further, the barn included seven fan assemblies (e.g., 42). More particularly, each of three 36-inch fan assemblies were associated with a corresponding roof vent (e.g. 34). The three roof vents were approximately evenly spaced along the peak of the curing barn. Additionally, the curing barn had a 36-inch fan associated with each of the four walls (e.g., 16). These wall fans were fitted with doors to allow closure of the corresponding openings (e.g., when not in use). However, while the curing barn include four wall fans, none of the wall fans were on, nor were any of the corresponding doors opened during any portion of the curing process.

TABLE 1

| Sample | Moisture | TSNA, as is | TSNA, Dry |
|---|---|---|---|
| 1 | 30.0% | 0.54 | 0.77 |
| 2 | 26.6% | 1.49 | 2.03 |
| 3 | 44.8% | 0.41 | 0.74 |
| 4 | 29.7% | 0.42 | 0.60 |
| 5 | 32.8% | 0.39 | 0.58 |
| 6 | 36.6% | 0.41 | 0.65 |
| 7 | 37.1% | 0.96 | 1.53 |
| 8 | 33.4% | 0.56 | 0.84 |
| 9 | 29.7% | 0.96 | 1.37 |
| 10 | 30.6% | 0.40 | 0.58 |
| | | Avg = | 0.97 |
| | | Std Dev = | 0.50 |
| | | Max = | 2.03 |
| | | Min = | 0.58 |
| 11 | 33.0% | 0.79 | 1.18 |
| 12 | 34.4% | 0.28 | 0.43 |
| 13 | 33.4% | 0.29 | 0.44 |
| 14 | 42.8% | 1.84 | 3.22 |
| 15 | 33.2% | 0.84 | 1.26 |
| 16 | 35.4% | 0.60 | 0.93 |
| 17 | 36.1% | 0.64 | 1.00 |
| 18 | 38.6% | 1.11 | 1.81 |
| 19 | 40.8% | 0.45 | 0.76 |
| 20 | 41.2% | 0.32 | 0.54 |
| | | Avg = | 1.16 |
| | | Std Dev = | 0.84 |
| | | Max = | 3.22 |
| | | Min = | 0.43 |

Approximately one day after housing the tobacco, the fan assemblies associated with the roof were turned on. More particularly, what may be characterized as an air drying portion of the curing process included all three of the roof fans running and the corresponding doors (e.g., 37) being open. Again, the doors associated with the wall fans were closed, and the wall fans were not used. Additional ventilation included six-inch high foundation ventilators (e.g., wall vents 56) that spanned the substantial length (e.g., 68) of the side walls (e.g., 16*a*), which were open during the entire drying process. Accordingly, ambient air (the temperature and humidity of which was not manipulated) from outside the curing barn was at least generally circulated through the curing barn via employment of the various venting and fan assemblies. This drying process was allowed to take place for a duration of approximately 27 days. Tobacco-specific nitrosamine (TSNA) levels and moisture levels of each of the samples were then determined as of the completion of this drying portion of the curing process. These levels are provided in Table 1. It should be noted that the TSNA levels of the particular samples is provided in units of parts per million (ppm). Incidentally, samples 1-10 and samples 11-20 are included in separate calculations (e.g., averages, standard deviations) simply because samples 1-10 were housed on a south side of the curing barn during the air drying portion of the curing process, while samples 11-20 were housed on a north side of the curing barn during the air drying portion of the curing. Incidentally, a similar arrangement of chart data may be exhibited in other tables disclosed herein.

Turning to a dark firing portion of the first curing process, after the above-described 27-day duration of exposing the tobacco to the airflow, the fan assemblies associated with the roof vents were turned off, and a low-level fire consisting of smoldering wood and sawdust was started on the floor (e.g., 12) of the curing barn. It should be noted that the doors (e.g. 37) of the roof vents (e.g., 34), as well as the foundation ventilators (e.g., 56) were all open during this exposure of the tobacco to the combustion exhaust gases of the fire. The tobacco was exposed to these combustion exhaust gases (i.e., the fire was continuously lit) for a duration of about 30 days. TSNA levels of each of the samples were again determined as of the completion of this dark fire portion of the curing process and are provided in Table 2 in units of parts per million (ppm).

TABLE 2

| Sample | Moisture | TSNA, as is | TSNA, Dry |
|---|---|---|---|
| 1 | 17.2% | 1.24 | 1.50 |
| 2 | 17.6% | 3.21 | 3.90 |
| 3 | 18.8% | 2.31 | 2.84 |
| 4 | 18.9% | 1.85 | 2.28 |
| 5 | 18.2% | 2.78 | 3.40 |
| 6 | 18.2% | 2.19 | 2.68 |
| 7 | 20.2% | 8.74 | 10.95 |
| 8 | 19.1% | 1.86 | 2.30 |
| 9 | 17.9% | 3.10 | 3.78 |
| 10 | 17.2% | 2.03 | 2.45 |
| | | Avg = | 3.61 |
| | | Std Dev = | 2.68 |
| | | Max = | 10.95 |
| | | Min = | 1.50 |
| 11 | 18.8% | 2.05 | 2.52 |
| 12 | 18.6% | 1.21 | 1.49 |
| 13 | 18.8% | 1.40 | 1.72 |
| 14 | 19.3% | 1.35 | 1.67 |
| 15 | 19.0% | 2.15 | 2.65 |
| 16 | 19.0% | 2.51 | 3.10 |
| 17 | 16.8% | 1.84 | 2.21 |
| 18 | 17.3% | 1.72 | 2.08 |
| 19 | 17.0% | 2.48 | 2.99 |
| 20 | 15.8% | 3.27 | 3.88 |
| | | Avg = | 2.43 |
| | | Std Dev = | 0.75 |
| | | Max = | 3.88 |
| | | Min = | 1.49 |

By way of comparison, some Narrow Leaf Madole tobacco that came from the same field and that was treated (pre-harvest) in the substantially same manner as the Narrow Leaf Madole tobacco of Tables 1-2 was cured using a conventional dark fire curing process. The data associated with this conventional dark fire curing process is shown in Tables 3-4. The tobacco was harvested and, about seven days after harvest, housed in a curing barn. The curing barn used in this experiment also had a length (e.g., 68) of about 40 feet and a width (e.g., 70) of about 30 feet. Further, the curing barn had four tiers (e.g., 30*a-d*), and the tobacco inside the barn was divided into samples, each sample including tobacco from each of the four tiers. However, this curing barn included only one fan assembly (e.g., 42) and a corresponding roof vent (e.g. 34) approximately centrally positioned along the peak of the curing barn. Further, this curing barn was devoid of fans associated with any of the walls (e.g., 16), and was also devoid of foundation ventilators (e.g., 56).

TABLE 3

| Sample | Moisture | TSNA, as is | TSNA, Dry |
|---|---|---|---|
| 1 | 14.0% | 3.35 | 3.90 |
| 2 | 14.3% | 3.45 | 4.03 |
| 3 | 12.0% | 2.95 | 3.35 |
| 4 | 11.4% | 4.32 | 4.88 |
| 5 | 14.4% | 2.95 | 3.45 |
| 6 | 11.8% | 3.38 | 3.83 |
| 7 | 11.9% | 4.47 | 5.07 |
| 8 | 13.2% | 3.43 | 3.95 |
| 9 | 13.7% | 5.76 | 6.67 |
| | | Avg = | 4.35 |
| | | Std Dev = | 1.05 |
| | | Max = | 6.67 |
| | | Min = | 3.35 |
| 10 | 13.9% | 2.56 | 2.97 |
| 11 | 16.2% | 2.15 | 2.57 |
| 12 | 13.2% | 2.08 | 2.40 |
| 13 | 12.4% | 2.62 | 2.99 |
| 14 | 12.3% | 3.88 | 4.42 |
| 15 | 11.9% | 3.21 | 3.64 |
| | | Avg = | 3.17 |
| | | Std Dev = | 0.75 |
| | | Max = | 4.42 |
| | | Min = | 2.40 |

TABLE 4

| Sample | Moisture | TSNA, as is | TSNA, Dry |
|---|---|---|---|
| 1 | 12.3% | 15.61 | 17.80 |
| 2 | 14.4% | 6.61 | 7.72 |
| 3 | 13.0% | 3.00 | 3.45 |
| 4 | 14.7% | 11.06 | 12.97 |
| 5 | 16.4% | 4.08 | 4.88 |
| 6 | 15.8% | 3.3 | 3.92 |
| 7 | 17.1% | 3.59 | 4.33 |
| 8 | 15.4% | 2.96 | 3.50 |
| 9 | 15.6% | 2.52 | 2.99 |
| | | Avg = | 6.84 |
| | | Std Dev = | 5.18 |
| | | Max = | 17.80 |
| | | Min = | 2.99 |
| 10 | 15.8% | 2.68 | 3.18 |
| 11 | 15.4% | 2.35 | 2.78 |
| 12 | 15.2% | 2.86 | 3.37 |
| 13 | 15.0% | 3.97 | 4.67 |
| 14 | 15.6% | 4.00 | 4.74 |
| 15 | 14.0% | 3.09 | 3.59 |
| | | Avg = | 3.72 |
| | | Std Dev = | 0.81 |
| | | Max = | 4.74 |
| | | Min = | 2.78 |

Approximately one day after housing the tobacco, a low-level fire consisting of smoldering wood and sawdust was started on the floor (e.g., 12) of the curing barn. It should be noted that the door (e.g. 37) of the single roof vent (e.g., 34) was open during this exposure of the tobacco to the combustion exhaust gases of the fire; however, the fan assembly was not on during any portion of this dark firing step. The tobacco was exposed to these combustion exhaust gases for a duration of about 15 days. TSNA levels of each of the fifteen samples were then determined as of the completion of dark firing of the tobacco and are provided in Table 3 in units of parts per million (ppm).

Referring to the portion of the conventional curing process associated with Table 4, for a duration of about 17 days, the samples of Table 3 remained in the curing barn with the roof vent open. No fire existed in the curing barn during these time period. This duration of time is generally referred to as a time in which the tobacco is allowed to "come into order". In other words, the tobacco is allowed to increase in moisture content by taking on humidity, for example, from ambient air. This is generally done to enhance a physical integrity of the tobacco. In other words, this increase in moisture content of the tobacco generally reduces a likelihood of the tobacco crumbling, cracking, or the like during subsequent handling. TSNA levels of each of the samples were then determined as of the completion of dark firing the tobacco and are provided in Table 4 in units of parts per million (ppm).

A comparison of the data from Tables 1-2 with the data of Tables 3-4 indicates that curing the tobacco in the manner described in relation to Tables 1-2 provides a cured tobacco with a reduced TSNA content relative to the tobacco cured in the conventional manner described in regard to Tables 3-4. Indeed, the curing process associated with Tables 1-2 provided a cured, finished tobacco exhibiting a total average dry TSNA content of only about 3 ppm (FIG. 2), while the conventional curing process associated with Tables 3-4 provided a cured, finished tobacco exhibiting a total average dry TSNA content of about 5.6 ppm (FIG. 4). In other words, the curing process associated with Tables 1-2 provided a cured, finished tobacco exhibiting about a 46% reduction in average dry TSNA content relative to the substantially same tobacco cured in accordance with the conventional method associated with Tables 3-4. Referring to Table 1, after the air drying portion of the curing process, the dry TSNA content of the overwhelming majority of samples was below about 2 ppm. Further, after the dark fire portion of the curing process, the dry TSNA content of the overwhelming majority of samples was below about 4 ppm (Table 2).

TABLE 5

| Sample | Moisture | TSNA, as is | TSNA, Dry |
|---|---|---|---|
| 1 | 22.9% | 1.38 | 1.79 |
| 2 | 25.1% | 0.68 | 0.91 |
| 3 | 24.4% | 1.42 | 1.88 |
| 4 | 25.3% | 0.57 | 0.76 |
| 5 | 25.0% | 0.45 | 0.60 |
| 6 | 26.5% | 0.64 | 0.87 |
| 7 | 25.4% | 1.24 | 1.66 |
| 8 | 22.4% | 1.47 | 1.89 |
| 9 | 20.4% | 2.26 | 2.84 |
| 10 | 25.2% | 0.36 | 0.48 |
| | | Avg = | 1.37 |
| | | Std Dev = | 0.76 |
| | | Max = | 2.84 |
| | | Min = | 0.48 |
| 11 | 22.4% | 1.72 | 2.22 |
| 12 | 24.8% | 0.28 | 0.37 |

TABLE 5-continued

| Sample | Moisture | TSNA, as is | TSNA, Dry |
|---|---|---|---|
| 13 | 23.2% | 0.30 | 0.39 |
| 14 | 22.2% | 1.49 | 1.92 |
| 15 | 24.2% | 1.66 | 2.19 |
| 16 | 25.6% | 1.00 | 1.34 |
| 17 | 24.5% | 1.31 | 1.74 |
| 18 | 25.2% | 0.39 | 0.52 |
| 19 | 22.4% | 0.74 | 0.95 |
| 20 | 26.0% | 0.39 | 0.53 |
| | | Avg = | 1.22 |
| | | Std Dev = | 0.76 |
| | | Max = | 2.22 |
| | | Min = | 0.37 |

Another set of experiments was directed to the affects various fertilizers may have on curing processes of the invention. Incidentally, unless stated otherwise, the tobacco discussed in the experiments associated with Tables 1-15 was grown employing a conventional fertilizer exhibiting a nitrogen content of greater than 200 units/acre. Referring to the procedure that was utilized to cure Narrow Leaf Madole tobacco represented in Tables 5-6, a conventional fertilizer was utilized to treat the tobacco at one or more times prior to harvest. The tobacco was harvested and, about two days after harvest, housed in the curing barn. Incidentally, the curing barn used in this experiment was the same curing barn used to cure the tobacco of Tables 1-2. The same day the tobacco was housed, the fan assemblies of the curing barn were turned on. More particularly, the air drying portion of this curing process included all three of the roof fans running and the corresponding doors (e.g., 37) being open. The doors associated with the wall fans were closed and the wall fans were not used. The foundation ventilators (e.g., wall vents 56) were also open during the entire drying process. This air drying of the tobacco was allowed to take place for a duration of approximately 61 days. TSNA levels of samples of the dried tobacco that were taken from various locations in the curing barn were then determined and are provided in Table 5 in units of parts per million (ppm).

TABLE 6

| Sample | Moisture | TSNA, as is | TSNA, Dry |
|---|---|---|---|
| 1 | 24.5% | 1.05 | 1.39 |
| 2 | 25.3% | 0.66 | 0.88 |
| 3 | 22.8% | 0.86 | 1.11 |
| 4 | 21.8% | 0.98 | 1.25 |
| 5 | 23.5% | 0.53 | 0.69 |
| 6 | 24.3% | 0.37 | 0.49 |
| 7 | 24.0% | 0.74 | 0.97 |
| 8 | 22.2% | 0.67 | 0.86 |
| 9 | 23.8% | 0.60 | 0.79 |
| 10 | 21.8% | 0.52 | 0.66 |
| | | Avg = | 0.91 |
| | | Std Dev = | 0.28 |
| | | Max = | 1.39 |
| | | Min = | 0.49 |
| 11 | 21.2% | 0.34 | 0.43 |
| 12 | 21.9% | 1.79 | 2.29 |
| 13 | 21.1% | 0.35 | 0.44 |
| 14 | 21.4% | 2.31 | 2.94 |
| 15 | 21.6% | 0.34 | 0.43 |
| 16 | 19.9% | 0.30 | 0.37 |
| 17 | 22.2% | 0.40 | 0.51 |
| 18 | 22.6% | 0.69 | 0.89 |
| 19 | 22.2% | 0.73 | 0.94 |
| 20 | 20.0% | 0.35 | 0.44 |

TABLE 6-continued

| Sample | Moisture | TSNA, as is | TSNA, Dry |
|---|---|---|---|
| | | Avg = | 0.97 |
| | | Std Dev = | 0.90 |
| | | Max = | 2.94 |
| | | Min = | 0.37 |

Still referring to the curing experiments associated with FIGS. 5-6, subsequent to the air curing phase of the curing process, the fan assemblies associated with the roof vents were shut off, and a low-level fire consisting of smoldering wood and sawdust was started on the floor (e.g., 12) of the curing barn. It should be noted that the doors (e.g. 37) of the roof vents (e.g., 34), as well as the foundation ventilator (e.g., 56) were all open during this exposure of the tobacco to the emissions (e.g., smoke) from the fire. The tobacco was exposed to these emissions (i.e., the fires effectively were continuously lit) for a duration of about 45 days. TSNA levels of each of the samples were then determined as of the completion of this dark fire portion of the curing process and are provided in Table 6 in units of parts per million (ppm).

One important result of the experiments related to Tables 5-6 is that the average TSNA level of these 20 samples was lower after the dark firing portion of the curing process than prior to the dark firing portion of the curing process. In addition, after the air drying portion of the curing process, the dry TSNA content of the overwhelming majority of samples was below about 2 ppm (Table 5). Further, after the dark fire portion of the curing process, the dry TSNA content of the overwhelming majority of samples was below about 1.5 ppm (Table 6). Another comparison that may be made is in relation to the data of Tables 1-2 versus the data of Tables 5-6. More particularly, the tobacco that was harvested and cured during a later portion of the calendar year (Tables 5-6) tended to exhibit lower TSNA levels that the tobacco harvest and cured during an earlier portion of the calendar year (Tables 1-2). This phenomenon may be due to a lower microbial count associated with the late crop due, at least in part, to lower ambient temperatures during the air drying portion of the curing process. Another factor that may contribute to this phenomenon is that humidity levels of the ambient air tend to be lower in the later portions of the year. These reduced humidity levels may contribute to lower TSNA content by reducing the microbial count of the tobacco.

In the experiments related to Tables 7-8, a fertilizer that was substantially free of nitrogen was the only fertilizer used to treat the Narrow Leaf Madole tobacco prior to harvest. In other words, while other substances may have been utilized in growing the tobacco, those substances were substantially devoid of nitrogen. The tobacco was harvested and, about five days after harvest, housed in the curing barn. The same day the tobacco was housed, the fan assemblies of the curing barn were turned on to provide an active airflow for air drying the tobacco. More particularly, the air drying portion of this curing process included all of the roof fans running and the corresponding doors (e.g., 37) being open. The doors associated with the wall fans were closed, and the wall fans were not used. The foundation ventilators (e.g., wall vents 56) were also open during the entire air drying portion of the curing process. This air drying of the tobacco was allowed to take place for a duration of approximately 65 days. TSNA levels of a number of samples of the dried tobacco that were taken from different locations in the curing barn were determined and are provided in Table 7 in units of parts per million (ppm).

Still referring to the experiments associated with FIGS. 7-8, upon completion of the air drying portion of the curing process, the fan assemblies associated with the roof vents were shut off, and a low-level fire consisting of combusting wood and sawdust was started on the floor (e.g., 12) of the curing barn. It should be noted that the doors (e.g. 37) of the roof vents (e.g., 34), as well as the foundation ventilator (e.g., 56) were all open during this exposure of the tobacco to the combustion exhaust gases of the fire. The tobacco was exposed to these combustion exhaust gases (i.e., the fires effectively were continuously lit, and the tobacco was dark fire treated) for a duration of about 56 days. TSNA levels of each of the samples were then determined as of the completion of this dark fire portion of the curing process and are provided in Table 8 in units of parts per million (ppm).

TABLE 7

| Sample | Moisture | TSNA, as is | TSNA, Dry |
|---|---|---|---|
| 1 | 22.4% | 0.63 | 0.81 |
| 2 | 23.6% | 0.64 | 0.84 |
| 3 | 23.3% | 0.58 | 0.76 |
| 4 | 21.4% | 0.72 | 0.92 |
| 5 | 21.2% | 0.19 | 0.24 |
| 6 | 25.9% | 0.67 | 0.90 |
| 7 | 22.0% | 0.48 | 0.62 |
| 8 | 23.0% | 0.68 | 0.88 |
| 9 | 22.4% | 0.49 | 0.63 |
| 10 | 21.9% | 0.27 | 0.35 |
| | | Avg = | 0.69 |
| | | Std Dev = | 0.24 |
| | | Max = | 0.92 |
| | | Min = | 0.24 |
| 11 | 19.0% | 0.18 | 0.22 |
| 12 | 21.8% | 0.42 | 0.54 |
| 13 | 18.9% | 0.17 | 0.21 |
| 14 | 23.8% | 0.28 | 0.37 |
| 15 | 18.8% | 0.08 | 0.10 |
| 16 | 20.2% | 0.12 | 0.15 |
| 17 | 22.3% | 0.35 | 0.45 |
| 18 | 17.0% | 0.40 | 0.48 |
| 19 | 17.5% | 0.11 | 0.13 |
| 20 | 18.9% | 0.07 | 0.09 |
| | | Avg = | 0.27 |
| | | Std Dev = | 0.17 |
| | | Max = | 0.54 |
| | | Min = | 0.09 |

The data of Tables 7-8 indicate that the average dry TSNA level of the 20 samples was lower after the dark firing portion of the curing process than prior to the dark firing portion of the curing process. More particularly, after the air drying portion of the curing process, the dry TSNA content of the overwhelming majority of samples was below about 1 ppm (Table 7). Further, after the dark fire portion of the curing process, the dry TSNA content of all of the samples was below about 0.8 ppm (Table 8). In comparing the data of Tables 7-8 to the data of Tables 5-6, it may be said that the use of fertilizer having no nitrogen content to treat the tobacco prior to harvest may beneficially contribute to the hindrance of TSNA formation in curing processes of the invention. That is, even more preferable TSNA levels of dark fire tobacco have been shown to be attainable by using a combination of nitrogen-free fertilizer treatment and a curing process of the present invention. These beneficial results may be said to be due, at least in part, to a lack or at least a reduced level of TSNA precursors associated with the tobacco as a result of utilizing a nitrogen-free fertilizer.

TABLE 8

| Sample | Moisture | TSNA, as is | TSNA, Dry |
|---|---|---|---|
| 1 | 17.1% | 0.42 | 0.51 |
| 2 | 12.9% | 0.45 | 0.52 |
| 3 | 17.0% | 0.33 | 0.40 |
| 4 | 16.5% | 0.65 | 0.78 |
| 5 | 13.6% | 0.08 | 0.09 |
| 6 | 15.1% | 0.18 | 0.21 |
| 7 | 15.7% | 0.15 | 0.18 |
| 8 | 13.8% | 0.13 | 0.15 |
| 9 | 13.2% | 0.17 | 0.20 |
| 10 | 13.5% | 0.15 | 0.17 |
| | | Avg = | 0.32 |
| | | Std Dev = | 0.22 |
| | | Max = | 0.78 |
| | | Min = | 0.09 |
| 11 | 15.4% | 0.16 | 0.19 |
| 12 | 15.7% | 0.19 | 0.23 |
| 13 | 15.5% | 0.11 | 0.13 |
| 14 | 17.4% | 0.27 | 0.33 |
| 15 | 15.0% | 0.13 | 0.15 |
| 16 | 14.2% | 0.17 | 0.20 |
| 17 | 14.1% | 0.10 | 0.12 |
| 18 | 14.0% | 0.14 | 0.16 |
| 19 | 13.7% | 0.17 | 0.20 |
| 20 | 14.0% | 0.20 | 0.23 |
| | | Avg = | 0.19 |
| | | Std Dev = | 0.06 |
| | | Max = | 0.33 |
| | | Min = | 0.12 |

Table 9 illustrates that treatment of tobacco with a low-nitrogen content fertilizer (no more than about 200 units/acre) also has a beneficial affect when combined with a curing process of the present invention. This low-nitrogen content fertilizer was utilized to treat the tobacco at one or more times prior to harvest. The tobacco was harvested and, about four days after harvest, housed in the curing barn. The same day the tobacco was housed, the fan assemblies of the curing barn were turned on to provide an active ambient airflow for air drying the tobacco. More particularly, the air drying portion of this curing process included all three of the roof fans running and the corresponding doors (e.g., 37) being open. The doors associated with the wall fans were closed, and the wall fans were not used. The foundation ventilators (e.g., wall vents 56) were also open during the entire drying process. This air drying portion of the curing process was allowed to take place for a duration of approximately 45 days. TSNA levels of samples of the dried tobacco that were taken from various locations in the curing barn were then determined and are provided toward the left side of Table 9 in units of parts per million (ppm).

TABLE 9

| Samples | Moisture | TSNA ppm; as is | TSNA ppm; dry |
|---|---|---|---|
| DRY | | | |
| 1 | 22.6% | 1.24 | 1.60 |
| 2 | 23.6% | 2.60 | 3.40 |
| 3 | 25.9% | 0.98 | 1.32 |
| 4 | 25.4% | 1.93 | 2.59 |
| 5 | 24.7% | 0.64 | 0.86 |
| 6 | 26.5% | 1.10 | 1.50 |
| 7 | 21.8% | 0.70 | 0.90 |
| 8 | 23.2% | 0.61 | 0.79 |
| 9 | 24.4% | 0.65 | 0.86 |
| 10 | 23.9% | 0.69 | 0.91 |

TABLE 9-continued

| Samples | Moisture | TSNA ppm; as is | TSNA ppm; dry |
|---|---|---|---|
| | | Avg = | 1.47 |
| | | StdDev = | 0.87 |
| FINISHED | | | |
| 1 | 21.5% | 5.85 | 7.45 |
| 2 | 20.9% | 3.44 | 4.35 |
| 3 | 22.7% | 7.16 | 9.26 |
| 4 | 20.7% | 1.10 | 1.39 |
| 5 | 21.9% | 0.93 | 1.19 |
| 6 | 19.9% | 4.70 | 5.87 |
| 7 | 21.7% | 0.87 | 1.11 |
| 8 | 21.0% | 1.22 | 1.54 |
| 9 | 20.4% | 2.93 | 3.68 |
| 10 | 20.6% | 5.11 | 6.44 |
| | | Avg = | 4.23 |
| | | StdDev = | 2.94 |

Upon completion of the air drying portion of the curing process, the fan assemblies associated with the roof vents were turned off, and a low-level fire consisting of combusting wood and sawdust was started on the floor (e.g., 12) of the curing barn. The doors (e.g. 37) of the roof vents (e.g., 34), as well as the foundation ventilators (e.g., 56) were all open during this exposure of the tobacco to the combustion exhaust gases of the fire. The tobacco was exposed to these combustion exhaust gases (i.e., the tobacco was dark fire treated) for a duration of about 49 days. TSNA levels of each of the samples were again determined as of the completion of this dark fire portion of the curing process and are provided toward the right side of Table 9 in units of parts per million (ppm).

After the air drying portion of the curing process associated with Table 9, the average dry TSNA content of the samples was about 1.5 ppm. Further, after the dark fire portion of the curing process, the average dry TSNA content of the samples was about 4 ppm. Accordingly, the use of fertilizer having little nitrogen content to treat the tobacco prior to harvest may facilitate the provision of cured tobacco having desirable TSNA levels. As such, in some embodiments of the invention, fertilizers containing low levels of nitrogen may be utilized to facilitate growth of the tobacco. An example of an appropriate fertilizer having low levels of nitrogen would be one that, when spread according to the manufacturer's guidelines, includes no more than about 200 pounds of actual nitrogen per acre.

TABLE 10

| Sample | Moisture | TSNA ppm; as is | TSNA ppm; dry |
|---|---|---|---|
| 1 | 14.5% | 6.16 | 7.20 |
| 2 | 15.0% | 5.71 | 6.72 |
| 3 | 15.3% | 4.08 | 4.82 |
| 4 | 14.5% | 5.35 | 6.26 |
| | | Avg = | 6.25 |
| | | StdDev = | 1.03 |
| | | COV = | 16.48 |
| 5 | 14.4% | 8.53 | 9.96 |
| 6 | 15.4% | 7.84 | 9.27 |
| 7 | 15.7% | 6.92 | 8.21 |
| 8 | 14.1% | 7.74 | 9.01 |
| 9 | 12.3% | 9.75 | 11.12 |
| | | Avg = | 9.51 |
| | | StdDev = | 1.09 |

TABLE 10-continued

| Sample | Moisture | TSNA ppm; as is | TSNA ppm; dry |
|---|---|---|---|
| | | COV = | 11.51 |
| 10 | 14.5% | 6.83 | 7.99 |
| 11 | 16.0% | 3.26 | 3.88 |
| 12 | 16.0% | 5.10 | 6.07 |
| 13 | 15.5% | 5.83 | 6.90 |
| 14 | 14.7% | 2.99 | 3.51 |
| | | Avg = | 5.67 |
| | | StdDev = | 1.93 |
| | | COV = | 34.08 |
| 15 | 16.0% | 8.67 | 10.32 |
| 16 | 16.0% | 7.00 | 8.33 |
| 17 | 16.1% | 6.42 | 7.65 |
| 18 | 16.0% | 7.07 | 8.42 |
| 19 | 13.8% | 4.36 | 5.06 |
| | | Avg = | 7.96 |
| | | StdDev = | 1.90 |
| | | COV = | 23.88 |
| 20 | 16.3% | 9.95 | 11.89 |
| 21 | 15.7% | 9.71 | 11.52 |
| 22 | 14.9% | 4.04 | 4.75 |
| 23 | 17.1% | 2.75 | 3.32 |
| 24 | 15.0% | 3.10 | 3.65 |
| | | Avg = | 7.02 |
| | | StdDev = | 4.31 |
| | | COV = | 61.31 |
| 25 | 14.5% | 4.99 | 5.84 |
| 26 | 15.3% | 7.62 | 9.00 |
| 27 | 15.0% | 5.44 | 6.40 |
| 28 | 15.5% | 8.13 | 9.62 |
| 29 | 13.5% | 3.42 | 3.95 |
| | | Avg = | 6.96 |
| | | StdDev = | 2.34 |
| | | COV = | 33.57 |

Table 10 illustrates data indicative of a number of varieties of dark fire tobacco that were cured in accordance with a conventional curing process. In particular, samples 1-4 were KY 171, samples 5-9 were VA 309, samples 10-14 were Narrow Leaf Madole, samples 15-19 were Tom Rosson Madole, samples 20-24 were VA 359, and samples 25-29 were TN D950. This tobacco was harvested and, about one or two days after harvest, housed in a curing barn. Approximately seven days after housing the tobacco, a low-level fire consisting of combusting wood and sawdust was started on the floor of the curing barn. The tobacco was exposed to these combustion exhaust gases (i.e., the fires effectively were continuously lit, and the tobacco was dark fire treated) for a duration of about 25 days. It should be noted that no significant amount of air drying was allowed to take place prior to the dark fire treatment. No fans were activated during any portion of the time that the tobacco was housed in the curing barn. TSNA levels of each of the samples was determined as of the completion of this dark fire portion of the curing process and are provided in Table 10 in units of parts per million (ppm).

FIG. 11, like FIG. 10, shows data indicative of a number of control samples regarding a number of dark fire tobacco varieties. In particular, samples 1-8 were Narrow Leaf Madole, samples 9-11 were TN D950, and samples 12-13 were Little Crittendon. This tobacco was harvested and, about four days after harvest, housed in a curing barn. Approximately eight days after housing the tobacco, a low-level fire consisting of combusting wood and sawdust was started on the floor of the curing barn. The tobacco was exposed to these combustion exhaust gases (i.e., dark fire treated) for a duration of about 53 days. TSNA levels of each of the samples were then determined as of the completion of this dark fire portion of the curing process and are provided in Table 11 in units of parts per million (ppm).

TABLE 11

| Sample | Moisture. | TSNA ppm; as is | TSNA ppm; dry |
|---|---|---|---|
| 1 | 18.3% | 10.93 | 13.38 |
| 2 | 21.3% | 4.97 | 6.32 |
| 3 | 20.4% | 3.80 | 4.77 |
| 4 | 20.7% | 2.73 | 3.44 |
| 5 | 20.4% | 4.87 | 6.12 |
| 6 | 19.0% | 2.53 | 3.12 |
| 7 | 20.1% | 6.60 | 8.26 |
| 8 | 20.4% | 4.40 | 5.53 |
| | | Avg = | 6.37 |
| | | Std Dev = | 3.28 |
| 9 | 22.2% | 3.27 | 4.20 |
| 10 | 20.4% | 2.37 | 2.98 |
| 11 | 21.1% | 8.01 | 10.15 |
| | | Avg = | 5.78 |
| | | Std Dev = | 3.84 |
| 12 | 18.7% | 3.84 | 4.72 |
| 13 | 20.0% | 3.14 | 3.93 |
| | | Avg = | 4.32 |
| | | Std Dev = | 0.56 |

Table 12 is indicative of a curing experiment that included Narrow Leaf Madole (samples 1-27) and VA 359 (samples 28-31) tobacco. Samples 1-16 and 28-31 were grown employing a conventional fertilizer, while samples 17-27 were grown using only a low-nitrogen (less than about 200 units/acre) fertilizer. Incidentally, the curing barn used in this curing experiment (as well as the experiment associated with Table 13) had a length (e.g., 68) of about 60 feet and a width (e.g., 70) of about 30 feet. Further, the curing barn included five fan assemblies (e.g., 42), each associated with a corresponding roof vent (e.g. 34). The five roof vents were approximately evenly spaced along the peak of the curing barn.

The tobacco of Table 12 was housed in the curing barn about three days after harvest, and the five fan assemblies were started that same day. Further, what may be characterized as an ambient air drying portion of the curing experiment included the roof fans running and the corresponding doors (e.g., 37) being open. Additional ventilation included foundation ventilators (e.g., wall vents 56) that were open during the substantial entirety of this air drying of the tobacco. The air drying portion of the curing process was allowed to take place for a duration of approximately 51 days. Tobacco-specific nitrosamine (TSNA) levels and moisture levels of each of the samples were then determined as of the completion of this air drying portion of the curing process. These levels and are provided on the left side of Table 12. As with the other tables provided herein, the TSNA levels of the particular samples of FIG. 12 are provided in units of parts per million (ppm).

Referring to a dark firing portion of the curing experiment associated with Table 12, after the air drying portion of the process, the fan assemblies associated with the roof vents were turned off, and a low-level fire consisting of the combustion of wood and sawdust was started on the floor of the curing barn to initiate a dark fire portion of the curing process. The doors of the roof vents, as well as the foundation ventilators were all open during exposure of the tobacco to the combustion exhaust gases of the fire. The tobacco was exposed to these combustion exhaust gases (e.g., smoke) for a duration of about 36 days. TSNA levels of each of the samples were again determined as of the completion of this dark fire portion of the curing experiment and are provided toward the right side of Table 12 in units of parts per million (ppm).

TABLE 12

| Sample | % Moist. | TSNA ppm; as is | TSNA ppm; dry |
|---|---|---|---|
| DRY | | | |
| 1 | 29.6 | 0.99 | 1.40 |
| 2 | 30.0 | 0.52 | 0.75 |
| 3 | 30.4 | 0.35 | 0.50 |
| 4 | 28.0 | 0.46 | 0.63 |
| 5 | 27.2 | 0.34 | 0.47 |
| 6 | 29.6 | 0.31 | 0.43 |
| 7 | 31.3 | 0.63 | 0.92 |
| 8 | 30.6 | 0.61 | 0.88 |
| 9 | 29.7 | 2.15 | 3.06 |
| 10 | 35.6 | 0.35 | 0.54 |
| 11 | 29.4 | 0.33 | 0.47 |
| 12 | 30.3 | 0.25 | 0.36 |
| 13 | 32.5 | 0.24 | 0.36 |
| 14 | 32.4 | 0.31 | 0.45 |
| 15 | 29.9 | 0.21 | 0.31 |
| 16 | 27.0 | 0.29 | 0.39 |
| | | Avg = | 0.74 |
| | | StdDev = | 0.68 |
| 17 | 27.6 | 2.41 | 3.33 |
| 18 | 24.6 | 1.92 | 2.55 |
| 19 | 29.4 | 0.38 | 0.53 |
| 20 | 31.2 | 0.16 | 0.23 |
| 21 | 30.5 | 0.24 | 0.35 |
| 22 | 29.6 | 0.48 | 0.68 |
| 23 | 29.5 | 0.22 | 0.31 |
| 24 | 29.2 | 0.39 | 0.55 |
| 25 | 30.1 | 0.74 | 1.05 |
| 26 | 30.4 | 0.52 | 0.75 |
| 27 | 28.0 | 0.17 | 0.24 |
| | | Avg = | 0.96 |
| | | StdDev = | 1.02 |
| 28 | 30.2 | 0.35 | 0.50 |
| 29 | 31.4 | 0.21 | 0.31 |
| 30 | 32.5 | 0.31 | 0.46 |
| 31 | 31.9 | 0.27 | 0.40 |
| | | Avg = | 0.42 |
| | | StdDev = | 0.08 |
| FINISHED | | | |
| 1 | 20.0 | 3.86 | 4.83 |
| 2 | 21.1 | 1.53 | 1.94 |
| 3 | 21.0 | 2.20 | 2.78 |
| 4 | 19.0 | 0.99 | 1.22 |
| 5 | 20.5 | 2.79 | 3.51 |
| 6 | 21.8 | 2.08 | 2.66 |
| 7 | 21.6 | 1.55 | 1.98 |
| 8 | 23.1 | 1.11 | 1.44 |
| 9 | 22.0 | 3.49 | 4.47 |
| 10 | 21.8 | 1.20 | 1.53 |
| 11 | 22.0 | 1.15 | 1.47 |
| 12 | 21.9 | 0.66 | 0.85 |
| 13 | 21.1 | 1.08 | 1.37 |
| 14 | 20.8 | 2.15 | 2.71 |
| 15 | 22.2 | 0.66 | 0.85 |
| 16 | 21.4 | 2.06 | 2.62 |
| | | Avg = | 2.27 |
| | | StdDev = | 1.20 |
| 17 | 19.5 | 0.76 | 0.94 |
| 18 | 18.7 | 1.41 | 1.73 |
| 19 | 21.5 | 1.40 | 1.78 |
| 20 | 21.4 | 0.34 | 0.43 |
| 21 | 19.5 | 2.82 | 3.50 |
| 22 | 20.1 | 1.51 | 1.89 |
| 23 | 21.9 | 1.56 | 2.00 |
| 24 | 21.3 | 1.07 | 1.36 |
| 25 | 20.6 | 1.55 | 1.95 |

TABLE 12-continued

| Sample | % Moist. | TSNA ppm; as is | TSNA ppm; dry |
|---|---|---|---|
| 26 | 19.8 | 0.86 | 1.07 |
| 27 | 20.8 | 1.21 | 1.53 |
| | | Avg = | 1.65 |
| | | StdDev = | 0.78 |
| 28 | 21.1 | 2.33 | 2.95 |
| 29 | 23.7 | 3.44 | 4.51 |
| 30 | 20.2 | 8.82 | 11.05 |
| 31 | 23.1 | 4.88 | 6.35 |
| | | Avg = | 6.22 |
| | | StdDev = | 3.51 |

Table 13 illustrates data indicative of a curing experiment in which Narrow Leaf Madole (samples 1-30) and VA 359 (samples 31-32) tobacco, grown without the use of one or both nitrogen-free and low-level nitrogen fertilizer, was harvested and housed in the curing barn about three days after harvest. The five fan assemblies were started the same day the tobacco was housed. This air drying of the tobacco was allowed to take place (e.g., ambient air was allowed to at least generally flow through the curing barn) for a duration of about 51 days. Tobacco-specific nitrosamine (TSNA) levels and moisture levels of each of the samples were then determined as of the completion of this air drying portion of the curing experiment. These levels and are provided on the left side of Table 13. As with the other tables provided herein, the TSNA levels of the particular samples of FIG. 13 are provided in units of parts per million (ppm).

Referring to a dark firing portion of the curing experiment associated with Table 13, after the air drying portion of the process, the fan assemblies associated with the roof vents were turned off, and a low-level fire consisting of smoldering wood and sawdust was started on the floor of the curing barn. The doors of the roof vents, as well as the foundation ventilators were all open during exposure of the tobacco to the emissions of the fire. The tobacco was exposed to these emissions (e.g., smoke) for about 36 days. TSNA levels of each of the samples were again determined as of the completion of this dark fire portion of the curing experiment and are provided toward the right side of Table 13 in units of parts per million (ppm).

TABLE 13

| Sample | % MOIST. | TSNA ppm; as is | TSNA ppm; dry |
|---|---|---|---|
| DRY | | | |
| 1 | 32.0 | 1.65 | 2.43 |
| 2 | 32.2 | 1.37 | 2.02 |
| 3 | 32.6 | 0.72 | 1.07 |
| 4 | 32.5 | 0.58 | 0.86 |
| 5 | 33.5 | 0.41 | 0.62 |
| 6 | 32.6 | 0.41 | 0.61 |
| 7 | 32.7 | 0.46 | 0.68 |
| 8 | 33.0 | 0.33 | 0.49 |
| 9 | 33.5 | 0.26 | 0.39 |
| 10 | 37.5 | 0.19 | 0.30 |
| 11 | 34.7 | 0.25 | 0.38 |
| 12 | 34.9 | 0.49 | 0.75 |
| 13 | 31.4 | 0.25 | 0.36 |
| 14 | 32.4 | 0.26 | 0.38 |
| 15 | 34.6 | 0.32 | 0.49 |
| 16 | 31.2 | 0.24 | 0.35 |
| | | Avg = | 0.76 |

TABLE 13-continued

| Sample | % MOIST. | TSNA ppm; as is | TSNA ppm; dry |
|---|---|---|---|
| | | Std Dev = | 0.61 |
| 17 | 30.5 | 0.33 | 0.47 |
| 18 | 30.6 | 0.39 | 0.56 |
| 19 | 30.6 | 0.58 | 0.84 |
| 20 | 32.5 | 0.96 | 1.42 |
| 21 | 32.0 | 0.27 | 0.40 |
| 22 | 35.1 | 0.36 | 0.55 |
| 23 | 34.4 | 0.26 | 0.40 |
| 24 | 35.5 | 0.24 | 0.37 |
| 25 | 36.0 | 0.15 | 0.23 |
| 26 | 33.7 | 0.36 | 0.54 |
| 27 | 36.9 | 0.32 | 0.51 |
| 28 | 34.3 | 0.40 | 0.61 |
| 29 | 34.4 | 0.31 | 0.47 |
| 30 | 39.5 | 0.21 | 0.35 |
| 31 | 36.4 | 0.23 | 0.36 |
| 32 | 35.5 | 0.23 | 0.36 |
| | | Avg = | 0.53 |
| | | Std Dev = | 0.28 |
| FINISHED | | | |
| 1 | 21.7 | 2.71 | 3.46 |
| 2 | 22.0 | 2.33 | 2.99 |
| 3 | 23.4 | 1.85 | 2.42 |
| 4 | 22.2 | 1.17 | 1.50 |
| 5 | 22.7 | 1.55 | 2.01 |
| 6 | 23.4 | 3.3 | 4.31 |
| 7 | 22.1 | 1.90 | 2.44 |
| 8 | 21.5 | 3.65 | 4.65 |
| 9 | 20.5 | 1.83 | 2.30 |
| 10 | 19.5 | 1.24 | 1.54 |
| 11 | 21.7 | 4.09 | 5.22 |
| 12 | 21.2 | 3.76 | 4.77 |
| 13 | 20.8 | 1.66 | 2.10 |
| 14 | 22.3 | 3.05 | 3.93 |
| 15 | 24.6 | 3.01 | 3.99 |
| 16 | 26.9 | 1.11 | 1.52 |
| | | Avg = | 3.07 |
| | | Std Dev = | 1.26 |
| 17 | 21.5 | 2.04 | 2.60 |
| 18 | 21.2 | 1.41 | 1.79 |
| 19 | 22.5 | 1.56 | 2.01 |
| 20 | 21.0 | 1.88 | 2.38 |
| 21 | 21.5 | 2.36 | 3.01 |
| 22 | 25.4 | 1.98 | 2.65 |
| 23 | 29.1 | 1.44 | 2.03 |
| 24 | 21.4 | 1.89 | 2.40 |
| 25 | 22.5 | 1.23 | 1.59 |
| 26 | 25.2 | 1.59 | 2.13 |
| 27 | 24.4 | 1.38 | 1.83 |
| 28 | 22.5 | 2.46 | 3.17 |
| 29 | 22.0 | 1.67 | 2.14 |
| 30 | 25.4 | 2.53 | 3.39 |
| 31 | 24.8 | 2.41 | 3.20 |
| 32 | 20.5 | 3.73 | 4.69 |
| | | Avg = | 2.56 |
| | | Std Dev = | 0.79 |

A number of observations may be made in regard to the data of Tables 10-13 to illustrate the significance of utilizing a curing process of the invention in treating tobacco. For instance, the finished Narrow Leaf Madole tobacco cured in accordance with the curing process associated with Table 13 exhibited a total average dry TSNA content of only about 2.7 ppm (utilizing the data of samples 1-30), and the finished Narrow Leaf Madole tobacco of samples 1-16 of Table 12 exhibited a total average dry TSNA content of only about 2.3 ppm. Utilizing conventionally cured tobacco as a contrast, the finished Narrow Leaf Madole tobacco of samples 10-14 of Table 10 exhibited a total average dry TSNA content of about 5.7 ppm, and the finished Narrow Leaf Madole tobacco of samples 1-8 of Table 11 exhibited a total average dry TSNA content of about 6.4 ppm. On average, at least a 50% reduction in TSNA content was realized using tobacco curing processes of the invention associated with Tables 12-13 as compared to the conventional tobacco curing processes associated with Tables 10-11.

Further analysis of Tables 10-13 may be made in regard to other varieties of tobacco. For instance, the finished VA 359 tobacco cured in accordance with the curing process associated with Tables 12-13 exhibited a total average dry TSNA content of only about 5.5 ppm (using the data of samples 31-32 of Table 13 and samples 28-31 of Table 12). Utilizing conventionally cured tobacco as a contrast, the finished VA 359 tobacco of samples 20-24 of Table 10 exhibited a total average dry TSNA content of about 7 ppm. Accordingly, about a 22% reduction in TSNA content was realized using tobacco curing processes of the invention associated with Tables 12-13 as compared to the conventional tobacco curing process associated with Table 10.

Other information worth noting in regard to Table 12 is that samples 17-27 exhibited an average dry TSNA content of only about 1.7 ppm. This is generally believed to be due to a combination of treating the tobacco only with low-nitrogen fertilizer prior to harvest and curing the tobacco in accordance with the process described in relation to Table 12. While the curing process alone provided tobacco having an average dry TNSA content of only about 2.3 ppm, the use of the curing process in combination with a fertilization regimen including only low-nitrogen fertilizer (i.e., less than about 200 units/acre) provided tobacco having an average dry TSNA content of only about 1.7 ppm. In other words, this combination of low-nitrogen fertilizer treatment and a curing process of the invention may (at least as the data associated with Table 12 shows) provide tobacco exhibiting an average dry TSNA content that is about 27% less than that achieved by the curing process alone.

Table 14 shows data relating to another curing experiment. A conventional fertilizer was utilized to treat Narrow Leaf Madole tobacco at one or more times prior to harvest. The tobacco was harvested and housed in a curing barn about two days after harvest. Incidentally, the curing barn used in this experiment was similar to the curing barn used to cure the tobacco associated with Tables 12-13. The same day the tobacco was housed, the fan assemblies of the curing barn were turned on. More particularly, this air drying portion of the curing experiment included five of the roof fans running and the corresponding doors (e.g., 37) being open. The foundation ventilators (e.g., wall vents 56) were also open substantially throughout the air drying portion of the curing process. This air drying of the tobacco was allowed to take place for a duration of approximately 59 days. TSNA levels of the samples of the dried tobacco that were taken from different locations in the curing barn were then determined and are provided toward the left side of Table 14 in units of parts per million (ppm).

TABLE 14

| Sample | pH | % Moist. | TSNA as is | TSNA dry |
|---|---|---|---|---|
| 1 | 5.25 | 21.3 | 0.62 | 0.79 |
| 2 | 5.46 | 26.4 | 0.13 | 0.18 |
| 3 | 5.54 | 25.7 | 0.13 | 0.18 |
| 4 | 5.29 | 24.1 | 0.13 | 0.18 |
| 5 | 5.32 | 25.2 | 0.17 | 0.23 |
| 6 | 5.52 | 26.1 | 0.13 | 0.18 |
| 7 | 5.49 | 25.8 | 0.13 | 0.18 |
| 8 | 5.56 | 25.0 | 0.13 | 0.18 |

TABLE 14-continued

| Sample | pH | % Moist. | TSNA as is | TSNA dry |
|---|---|---|---|---|
| 9 | 5.58 | 26.8 | 0.13 | 0.18 |
| 10 | 5.59 | 23.3 | 0.13 | 0.17 |
| 11 | 5.84 | 19.1 | 0.13 | 0.16 |
| 12 | 5.53 | 24.0 | 0.41 | 0.54 |
| 13 | 5.58 | 26.2 | 0.12 | 0.16 |
| 14 | 5.60 | 25.6 | 0.03 | 0.04 |
| 15 | 5.45 | 25.0 | 0.03 | 0.04 |
| 16 | 5.71 | 24.0 | 0.03 | 0.04 |
| 17 | 5.68 | 22.0 | 0.19 | 0.24 |
| 18 | 5.66 | 26.4 | 0.14 | 0.19 |
| 19 | 5.52 | 25.0 | 0.26 | 0.35 |
| 20 | 5.66 | 22.0 | 0.03 | 0.03 |
| 21 | 5.46 | 25.0 | 0.03 | 0.04 |
| 22 | 5.52 | 24.2 | 0.03 | 0.04 |
| 23 | 5.58 | 25.1 | 0.03 | 0.04 |
| 24 | 5.37 | 24.3 | 0.03 | 0.04 |
| 25 | 5.61 | 26.1 | 0.03 | 0.04 |
| 26 | 5.67 | 22.6 | 1.45 | 1.88 |
| | | | Avg = | 0.24 |
| | | | StdDev = | 0.37 |
| 1 | 5.07 | 23.0 | 1.60 | 2.08 |
| 2 | 5.04 | 23.1 | 0.51 | 0.66 |
| 3 | 5.19 | 20.6 | 0.44 | 0.55 |
| 4 | 5.08 | 20.0 | 0.50 | 0.63 |
| 5 | 5.10 | 21.6 | 0.81 | 1.03 |
| 6 | 5.07 | 22.1 | 1.93 | 2.48 |
| 7 | 5.13 | 20.6 | 0.59 | 0.74 |
| 8 | 5.16 | 21.8 | 0.64 | 0.82 |
| 9 | 5.16 | 22.9 | 1.09 | 1.42 |
| 10 | 5.16 | 22.2 | 0.40 | 0.51 |
| 11 | 5.37 | 19.5 | 0.37 | 0.46 |
| 12 | 5.29 | 22.4 | 0.31 | 0.40 |
| 13 | 5.09 | 20.1 | 0.41 | 0.52 |
| 14 | 5.21 | 18.7 | 0.57 | 0.70 |
| 15 | 5.02 | 21.1 | 0.48 | 0.61 |
| 16 | 5.16 | 19.8 | 0.39 | 0.49 |
| 17 | 5.17 | 20.6 | 0.47 | 0.59 |
| 18 | 5.02 | 21.2 | 0.28 | 0.36 |
| 19 | 4.87 | 23.1 | 1.13 | 1.47 |
| 20 | 4.88 | 20.0 | 0.35 | 0.44 |
| 21 | 4.90 | 19.7 | 0.46 | 0.57 |
| 22 | 4.92 | 22.2 | 0.30 | 0.39 |
| 23 | 4.91 | 14.6 | 0.29 | 0.34 |
| 24 | 4.99 | 21.2 | 0.35 | 0.44 |
| 25 | 4.96 | 21.9 | 0.38 | 0.49 |
| 26 | 4.92 | 21.3 | 2.47 | 3.14 |
| | | | Avg = | 0.86 |
| | | | StdDev = | 0.71 |

A dark fire portion of the curing process was initiated upon completion of the air drying portion of the curing process. More particularly, the fan assemblies associated with the roof vents were shut off, and a low-level fire consisting of combusting wood and sawdust was started on the floor of the curing barn. The doors of the roof vents, as well as the foundation ventilators were all open while the tobacco was exposed to the smoke of the smoldering fire. The tobacco was exposed to the smoke (e.g., dark fire treated) for a duration of about 51 days. TSNA levels of each of the samples were then determined as of the completion of this dark fire portion of the curing process and are provided toward a right side of Table 14 in units of parts per million (ppm). It should be noted that an average dry TSNA content of the samples of Table 14 was only about 0.2 ppm upon completion of the air drying portion of the curing process and only about 0.9 ppm upon completion of the dark firing portion of the curing process.

TABLE 15

| Sample | pH | % Moist. | TSNA as is | TSNA dry |
|---|---|---|---|---|
| DRY | | | | |
| 1 | 5.74 | 29.40 | 0.33 | 0.47 |
| 2 | 5.72 | 28.70 | 0.15 | 0.21 |
| 3 | 5.63 | 29.90 | 0.06 | 0.09 |
| 4 | 5.57 | 30.50 | 0.11 | 0.15 |
| 5 | 5.56 | 29.50 | 0.06 | 0.09 |
| 6 | 5.78 | 29.70 | 0.06 | 0.09 |
| 7 | 5.80 | 28.40 | 0.21 | 0.29 |
| 8 | 5.78 | 32.40 | 0.06 | 0.09 |
| 9 | 5.69 | 26.50 | 0.29 | 0.39 |
| 10 | 5.60 | 29.10 | 0.85 | 1.19 |
| 11 | 5.70 | 28.20 | 0.96 | 1.34 |
| 12 | 5.46 | 31.40 | 0.73 | 1.06 |
| 13 | 5.69 | 29.60 | 0.62 | 0.88 |
| 14 | 5.42 | 29.40 | 1.21 | 1.72 |
| 15 | 5.57 | 31.40 | 0.66 | 0.96 |
| 16 | 5.58 | 30.20 | 0.37 | 0.53 |
| 17 | 5.49 | 31.30 | 0.50 | 0.73 |
| 18 | 5.58 | 31.60 | 0.32 | 0.47 |
| 19 | 5.63 | 27.80 | 0.59 | 0.82 |
| 20 | 5.57 | 31.00 | 0.35 | 0.50 |
| 21 | 5.54 | 30.60 | 0.49 | 0.71 |
| 22 | 5.50 | 28.10 | 0.29 | 0.41 |
| 23 | 5.68 | 27.50 | 0.30 | 0.41 |
| 24 | 5.97 | 30.10 | 0.19 | 0.27 |
| | | | Avg = | 0.58 |
| | | | StdDev = | 0.44 |
| 25 | 5.72 | 29.90 | 0.25 | 0.35 |
| 26 | 5.80 | 27.30 | 0.06 | 0.08 |
| 27 | 5.66 | 28.00 | 0.06 | 0.08 |
| 28 | 5.68 | 28.20 | 0.06 | 0.08 |
| | | | Avg = | 0.15 |
| | | | StdDev = | 0.13 |
| FINISHED | | | | |
| 1 | 5.26 | 20.90 | 2.40 | 3.04 |
| 2 | 5.08 | 21.60 | 1.45 | 1.85 |
| 3 | 5.06 | 21.60 | 1.37 | 1.74 |
| 4 | 5.01 | 23.60 | 1.41 | 1.84 |
| 5 | 4.93 | 23.80 | 1.32 | 1.73 |
| 6 | 4.89 | 23.60 | 1.19 | 1.56 |
| 7 | 5.04 | 24.40 | 1.10 | 1.46 |
| 8 | 5.01 | 23.50 | 0.64 | 0.84 |
| 9 | 5.22 | 21.20 | 0.62 | 0.79 |
| 10 | 5.06 | 24.70 | 0.40 | 0.53 |
| 11 | 5.08 | 24.60 | 0.27 | 0.35 |
| 12 | 4.90 | 27.80 | 0.22 | 0.30 |
| 13 | 4.99 | 24.00 | 0.32 | 0.42 |
| 14 | 4.95 | 24.00 | 0.59 | 0.78 |
| 15 | 4.86 | 24.80 | 0.31 | 0.42 |
| 16 | 5.00 | 24.40 | 0.26 | 0.34 |
| 17 | 4.93 | 27.00 | 0.34 | 0.47 |
| 18 | 4.95 | 23.30 | 0.12 | 0.16 |
| 19 | 5.10 | 23.20 | 0.11 | 0.15 |
| 20 | 5.12 | 26.20 | 0.20 | 0.27 |
| 21 | 5.19 | 24.10 | 0.35 | 0.47 |
| 22 | 5.08 | 25.20 | 0.27 | 0.37 |
| 23 | 5.01 | 24.50 | 0.53 | 0.70 |
| 24 | 5.02 | 25.10 | 0.41 | 0.55 |
| | | | Avg = | 0.88 |
| | | | StdDev = | 0.73 |
| 25 | 5.10 | 24.10 | 0.77 | 1.01 |
| 26 | 5.09 | 26.00 | 0.69 | 0.93 |
| 27 | 5.20 | 22.80 | 1.47 | 1.90 |
| 28 | 5.22 | 22.10 | 0.97 | 1.24 |
| | | | Avg = | 1.27 |
| | | | StdDev = | 0.44 |

In another experiment, the fan assemblies of the curing barn were turned on and off during various stages of an air drying portion of a curing process. More particularly, the fan assemblies of the curing barn were on (e.g., running) substantially throughout daylight hours and off substantially throughout a duration of each day in which daylight was not significantly present (e.g., nighttime and early morning). Table 15 includes the data of this experiment.

Referring to the tobacco curing process associated with the data of Table 15, Narrow Leaf Madole tobacco was harvested and housed in a curing barn about three days after harvest. Incidentally, the curing barn used in this experiment was similar to the curing barn used to cure the tobacco associated with Tables 12-13. The same day the tobacco was housed, the fan assemblies of the curing barn were turned on. However, these fans were only run during the daylight hours of each day. In other words, the five roof fans were not running during a duration of each day in which substantially no daylight was present. The foundation ventilators, as well as the roof vent associated with each of the fans, were open substantially throughout the air drying portion of the curing process (i.e., both day and night). This air drying of the tobacco was allowed to take place for a duration of approximately 41 days. TSNA levels of the samples of the dried tobacco that were taken were then determined and are provided toward a left side of Table 15 in units of parts per million (ppm).

Upon completion of the air drying portion of the curing process, a dark fire portion of the curing process was initiated. More particularly, the fan assemblies associated with the roof vents were shut off for the remainder of the curing process associated with Table 15, and a low-level fire consisting of combusting wood and sawdust was started on the floor of the curing barn. The doors of the roof vents, as well as the foundation ventilators, were all open while the tobacco was exposed to the smoke of the low-level fire. The tobacco was dark fire treated for a duration of about 62 days. TSNA levels of each of the samples were again determined as of the completion of this dark fire portion of the curing process and are provided toward a right side of Table 15 in units of parts per million (ppm). It should be noted that an average dry TSNA content of the samples of Table 15 was only about 0.6 ppm upon completion of the air drying portion of the curing process and only about 0.9 ppm upon completion of the dark firing portion of the curing process.

Still referring to Table 15, a conventional fertilizer was utilized to treat samples 1-24 of the tobacco at one or more times prior to harvest, and no nitrogen-free or low-level nitrogen fertilizer was utilized to treat those samples. By contrast, samples 25-28 of Table 15 were treated with a low-nitrogen fertilizer at one or more times prior to harvest. This tobacco grown with low-nitrogen fertilizer exhibited an average dry TSNA content of about 0.15 ppm upon completion of the air drying portion of the curing process and about 1.3 ppm upon completion of the dark firing portion of the curing process.

By way of comparison, some Narrow Leaf Madole tobacco that came from the same field as the Narrow Leaf Madole tobacco of Table 15 was cured using a conventional dark fire curing process. The data associated with this conventional dark fire curing process is shown in Table 16. The tobacco was harvested and housed in a curing barn about three days after harvest. Approximately four days after housing the tobacco, a low-level fire consisting of smoldering wood and sawdust was started on the floor of the curing barn. The door of the single roof vent was open during this exposure of the tobacco to the combustion exhaust gases of the fire. The tobacco was exposed to these combustion exhaust gases until for about 36 days. TSNA levels of each of the samples were then determined as of the completion of dark firing the tobacco and are provided in Table 16 in units of parts per million (ppm).

TABLE 16

| Finished Sample | pH | % Moist. | TSNA as is | TSNA dry |
|---|---|---|---|---|
| 1 | 4.57 | 20.5 | 7.23 | 9.09 |
| 2 | 4.50 | 21.4 | 3.48 | 4.42 |
| 3 | 4.51 | 21.0 | 3.00 | 3.80 |
| 4 | 4.52 | 20.9 | 4.04 | 5.10 |
| 5 | 4.55 | 20.2 | 7.90 | 9.90 |
| 6 | 4.55 | 20.2 | 3.90 | 4.88 |
| 7 | 4.46 | 20.0 | 4.42 | 5.53 |
| 8 | 4.86 | 22.9 | 9.37 | 12.15 |
| 9 | 4.63 | 20.4 | 5.96 | 7.49 |
| 10 | 4.71 | 18.5 | 5.54 | 6.79 |
| 11 | 5.09 | 19.9 | 29.91 | 37.35 |
| 12 | 4.80 | 20.5 | 30.51 | 38.38 |
| 13 | 4.90 | 20.0 | 9.85 | 12.31 |
| 14 | 5.07 | 21.4 | 6.92 | 8.80 |
| 15 | 4.79 | 20.1 | 4.12 | 5.15 |
| 16 | 4.98 | 17.5 | 7.50 | 9.09 |
| 17 | 5.00 | 15.6 | 4.76 | 5.64 |
| 18 | 4.79 | 18.5 | 6.06 | 7.44 |
| 19 | 4.75 | 18.6 | 3.05 | 3.74 |
| 20 | 4.62 | 18.1 | 5.28 | 6.44 |
| 21 | 4.59 | 20.1 | 2.79 | 3.49 |
| 22 | 4.63 | 19.6 | 5.55 | 6.90 |
| 23 | 4.58 | 19.3 | 4.84 | 6.00 |
| 24 | 4.65 | 18.0 | 2.49 | 3.03 |
| 25 | 4.57 | 19.9 | 2.40 | 3.00 |
| 26 | 4.59 | 19.9 | 4.57 | 5.70 |
| 27 | 4.71 | 20.3 | 6.43 | 8.07 |
| 28 | 4.60 | 20.6 | 5.06 | 6.38 |
| 29 | 4.58 | 20.4 | 5.54 | 6.96 |
| 30 | 4.88 | 20.3 | 6.16 | 7.72 |
| 31 | 4.80 | 19.1 | 12.92 | 15.97 |
| 32 | 4.75 | 19.9 | 6.15 | 7.68 |
| 33 | 4.72 | 20.2 | 4.12 | 5.16 |
| | | | Avg = | 8.78 |
| | | | StdDev = | 8.01 |
| 34 | 4.71 | 18.8 | 4.92 | 6.05 |
| 35 | 4.71 | 15.7 | 1.30 | 1.54 |
| 36 | 4.64 | 19.3 | 4.98 | 6.17 |
| 37 | 4.64 | 20.5 | 5.52 | 6.95 |
| | | | Avg = | 5.18 |
| | | | StdDev = | 2.46 |

A comparison of the data from Table 15 with the data of Table 16 indicates that curing the tobacco in the manner described in relation to Table 15 provides a cured tobacco with a reduced TSNA content relative to the tobacco cured in the conventional manner described in regard to Table 16. Indeed, the curing process associated with Table 15 provided a cured, finished tobacco exhibiting an average dry TSNA content of samples 1-24 of only about 0.9 ppm. This is significantly lower than the data of Table 16 in which the cured, finished tobacco of samples 1-33 exhibited a total average dry TSNA content of about 9 ppm. In other words, the curing process associated with Table 15 provided a cured, finished tobacco exhibiting almost a 90% reduction in average dry TSNA content relative to the substantially same tobacco cured in accordance with the conventional method associated with Table 16.

The tobacco of samples 25-28 of Table 15 and samples 34-37 of Table 16 was grown utilizing low-nitrogen fertilizer. With regard to these samples, Table 15 provides a cured tobacco with a reduced TSNA content relative to the tobacco cured in the conventional manner described in regard to Table 16. Indeed, the curing process associated with Table 15 provided a cured, finished tobacco exhibiting an average dry TSNA content of samples 25-28 of only about 1.3 ppm. This is significantly lower than the data of Table 16 in which the cured, finished tobacco of samples 34-37 exhibited a total average dry TSNA content of about 5 ppm. In other words, the low-nitrogen fertilizer treatment prior to the curing process associated with Table 15 provided a cured, finished tobacco exhibiting over a 75% reduction in average dry TSNA content relative to the substantially same tobacco that was low-nitrogen fertilizer treated but cured in accordance with the conventional method associated with Table 16.

Incidentally, a number of appropriate manners of determining and/or quantifying the amount of tobacco-specific nitrosamines of tobacco are known in the art. For example, an alkaline methylene chloride extraction protocol is one known appropriate manner that may be utilized to provide the TSNA content data indicated in Tables 1-16. This protocol at least generally enables one to determine a presence and amount of tobacco specific nitrosamines (TSNAs) such as N-nitrosonornicotine (NNN), N-nitrosoanatabine (NAT), N-nitrosoanabasine (NAB) and 4-(methylnitrosamino)-1-(3-pyridyl)-1-butanone (NNK) in ground tobacco, leaf tobacco, manufactured tobacco, and tobacco products by gas chromatography.

Summarily, TSNAs may be extracted from tobacco samples with methylene chloride containing sodium hydroxide (NaOH). The extract may then be eluted through a mixed bed of magnesium sulfate and sodium sulfate using methylene chloride, evaporated to near dryness, and reconstituted in chloroform or the like. The individual nitrosamines may then be separated and quantitated by gas chromatography using chemiluminescence detection. Quantification may be performed in any appropriate manner such as by a surrogate internal standard technique.

The examples above assist in illustrating that levels of TSNAs can be varied from crop to crop depending on the amount of nitrite and carbon dioxide present during growing and curing. Conventional dark fire curing methods expose the tobacco to combustion exhaust including $NO_x$ gases (generally resulting from fuel combustion) while the tobacco is green, yellow, or a combination thereof. Incidentally, these gases are believed to react with alkaloids in the tobacco to form TSNAs. Moreover, tobacco that is green, yellow, or a combination thereof generally exhibits a higher moisture content than tobacco that is substantially brown. This higher moisture content allows for increased absorption of or the ability to take on significant levels of $NO_x$ gases relative to substantially brown tobacco having a lower moisture content. The present invention effectively eliminates exposing the tobacco to combustion exhaust gases until the tobacco is substantially brown and exhibiting a moisture content of less than about 35%. This practice effectively hinders the ability of the tobacco to take on $NO_x$ and resultantly provides a dark fired tobacco product precursor exhibiting a desirably low TSNA content.

Those skilled in the art will now see that certain modifications can be made to the methods and apparatuses herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. A method of treating tobacco, the method comprising:

a first exposing step of exposing tobacco that has been harvested to an ambient airflow substantially devoid of combustion exhaust gases at least until said tobacco is substantially brown, wherein said first exposing step is initiated when said tobacco is at least one of green, yellow, and a combination thereof; and after said first exposing step, a second exposing step of exposing said tobacco to exhaust gases from combustion of at least one carbonaceous material.

2. A method, as claimed in claim 1, wherein:

said first exposing step comprises at least one of hindering formation of at least one tobacco-specific nitrosamine and hindering metabolic activity of at least one anaerobic microorganism.

3. A method, as claimed in claim 1, wherein:

said first exposing step comprises providing a substantially aerobic condition about said tobacco.

4. A method, as claimed in claim 3, wherein:

said second exposing step comprises providing a substantially anaerobic condition about said tobacco.

5. A method, as claimed in claim 1, wherein:

said first exposing step comprises drying said tobacco to a moisture content of no more than about 35%.

6. A method, as claimed in claim 1, wherein:

said first exposing step comprises drying said tobacco to a moisture content of between about 17% and about 35%.

7. A method, as claimed in claim 1, wherein:

said second exposing step comprises drying said tobacco to a moisture content of no more than about 16%.

8. A method, as claimed in claim 1, wherein:

said second exposing step comprises drying said tobacco to a moisture content of between about 12% and about 16%.

9. A method, as claimed in claim 1, wherein:

said tobacco comprises a dry nitrosamine content of no more than about 5 ppm upon completion of said first exposing step.

10. A method, as claimed in claim 1, wherein:

said tobacco comprises a dry nitrosamine content of no more than about 10 ppm after said second exposing step.

11. A method, as claimed in claim 1, wherein:

said tobacco comprises a dry nitrosamine content upon completion of said first exposing step and before initiation of said second exposing step, and wherein said second exposing step comprises reducing said dry nitrosamine content of said tobacco.

12. A method, as claimed in claim 1, further comprising:

after said second exposing step, a third exposing step of exposing said tobacco to ambient air for a time sufficient to increase a moisture content of said tobacco relative to a moisture content of said tobacco upon completion of said second exposing step.

13. A method, as claimed in claim 12, wherein:

said tobacco comprises a moisture content of between about 20% and about 25% after said third exposing step.

14. A method, as claimed in claim 1, further comprising:

avoiding any application of nitrogen-containing fertilizer to said tobacco prior to a harvesting of said tobacco.

15. A method, as claimed in claim 14, wherein:

said tobacco comprises a moisture content of no more than about 26% upon completion of said first exposing step.

16. A method, as claimed in claim 14, wherein:

said tobacco comprises a moisture content of between about 17% and about 26% upon completion of said first exposing step.

17. A method, as claimed in claim 14, wherein:

said tobacco comprises a moisture content of no more than about 17% upon completion of said second exposing step.

18. A method, as claimed in claim 14, wherein:
said tobacco comprises a moisture content of between about 12% and about 17% after said second exposing step.

19. A method, as claimed in claim 14, wherein:
said tobacco comprises a dry nitrosamine content of no more than about 4 ppm upon completion of said first exposing step.

20. A method, as claimed in claim 14, wherein:
said tobacco comprises a dry nitrosamine content of no more than about 8 ppm after said second exposing step.

21. A method of treating tobacco, the method comprising:
a first exposing step of exposing tobacco that has been harvested and that comprises an initial moisture content of no less than about 70% to an airflow substantially devoid of smoke at least until said tobacco comprises a moisture content of no more than about 35%; and
after said first exposing step, a second exposing step of exposing said tobacco to smoke from burning of carbonaceous material at least until said tobacco comprises a moisture content of no more than about 16%.

22. A method, as claimed in claim 21, wherein:
said first exposing step comprises hindering at least one of formation of at least one tobacco-specific nitrosamine and metabolic activity of at least one anaerobic microorganism.

23. A method, as claimed in claim 21, wherein:
said first exposing step comprises providing a substantially aerobic condition about said tobacco.

24. A method, as claimed in claim 21, wherein:
said first exposing step comprises drying said tobacco to a moisture content of between about 17% and about 35%.

25. A method, as claimed in claim 21, wherein:
said second exposing step comprises drying said tobacco to a moisture content of between about 12% and about 16%.

26. A method, as claimed in claim 21, wherein:
said tobacco comprises a dry nitrosamine content of no more than about 2 ppm upon completion of said first exposing step.

27. A method, as claimed in claim 21, wherein:
said tobacco comprises a dry nitrosamine content of no more than about 1 ppm after said second exposing step.

28. A method, as claimed in claim 21, wherein:
said tobacco comprises a first dry nitrosamine content upon completion of said first exposing step and before initiation of said second exposing step, wherein said tobacco comprises a second dry nitrosamine content upon completion of said second exposing step, and wherein said first dry nitrosamine content is greater than said second dry nitrosamine content.

29. A method, as claimed in claim 21, further comprising:
after said second exposing step, a third exposing step of exposing said tobacco to a flow of atmospheric air for a time sufficient to increase a moisture content of said tobacco to at least about 20%.

30. A method, as claimed in claim 21, further comprising:
preventing an application of nitrogen-containing fertilizer to said tobacco prior to a harvesting of said tobacco.

31. A method of treating tobacco, the method comprising:
a first exposing step of exposing tobacco that has been harvested to an airflow sufficient to provide an aerobic condition about said tobacco at least until said tobacco is substantially brown; and
after said first exposing step, a second exposing step of exposing said tobacco to emissions from burning carbonaceous material, wherein said tobacco comprises a first dry nitrosamine content upon completion of said first exposing step and before initiation of said second exposing step, wherein said tobacco comprises a second dry nitrosamine content upon completion of said second exposing step, and wherein said first dry nitrosamine content is greater than said second dry nitrosamine content.

32. A method, as claimed in claim 31, wherein:
said first exposing step comprises hindering at least one of formation of at least one tobacco-specific nitrosamine and metabolic activity of at least one anaerobic microorganism.

33. A method, as claimed in claim 31, wherein:
said first exposing step is initiated while said tobacco is green, yellow, or a combination thereof.

34. A method, as claimed in claim 31, wherein:
said tobacco comprises a dry nitrosamine content of no more than about 2 ppm upon completion of said first exposing step.

35. A method, as claimed in claim 34, wherein:
said tobacco comprises a dry nitrosamine content of no more than about 1 ppm after said second exposing step.

36. A method, as claimed in claim 31, further comprising:
avoiding an application of nitrogen-containing fertilizer to said tobacco prior to a harvesting of said tobacco.

37. A method, as claimed in claim 36, wherein:
said tobacco comprises a dry nitrosamine content of no more than about 1 ppm upon completion of said first exposing step.

38. A method, as claimed in claim 37, wherein:
said tobacco comprises a dry nitrosamine content of no more than about 0.75 ppm upon completion of said second exposing step.

39. A method of treating tobacco, the method comprising:
disposing tobacco that has been harvested in an aerobic environment for at least about 27 days; and
exposing said tobacco to smoke from combusting wood for at least about 25 days after said disposing step.

40. A method as claimed in claim 39, wherein:
said disposing step occurs for between about 27 days and about 61 days.

41. A method, as claimed in claim 39, wherein:
said exposing step occurs for between about 25 days and about 50 days.

42. A method, as claimed in claim 39, wherein:
said tobacco comprises a dry nitrosamine content of no more than about 2 ppm upon completion of said disposing step.

43. A method, as claimed in claim 42, wherein:
said tobacco comprises a dry nitrosamine content of no more than about 1 ppm after said exposing step.

44. A method, as claimed in claim 39, further comprising:
avoiding an application of nitrogen-containing fertilizer to said tobacco prior to a harvesting of said tobacco.

45. A method, as claimed in claim 44, wherein:
said tobacco comprises a dry nitrosamine content of no more than about 1 ppm after said disposing step.

46. A method of treating tobacco, the method comprising:
a first exposing step of exposing tobacco that has been harvested to an active, uncontrolled airflow sufficient to provide an aerobic condition about said tobacco until said tobacco is substantially free of enzymatic activity; and
after said first exposing step, a second exposing step of exposing said tobacco to exhaust gases from combustion of at least one carbonaceous material at least until a surface of said tobacco comprises a gloss or shine.

47. A method, as claimed in claim 46, wherein:

said second exposing step comprises accumulating phenols on said surface of said tobacco.

48. A method, as claimed in claim 46, wherein:

said first exposing step comprises hindering at least one of formation of at least one tobacco-specific nitrosamine and metabolic activity of at least one anaerobic microorganism.

49. A method, as claimed in claim 46, wherein:

said tobacco comprises a dry nitrosamine content of no more than about 2 ppm upon completion of said first exposing step.

50. A method, as claimed in claim 49, wherein:

said tobacco comprises a dry nitrosamine content of no more than about 1 ppm after said second exposing step.

51. A method, as claimed in claim 46, wherein:

said tobacco comprises a first dry nitrosamine content upon completion of said first exposing step and before initiation of said second exposing step, wherein said tobacco comprises a second dry nitrosamine content upon completion of said second exposing step, and wherein said first dry nitrosamine content is greater than said second dry nitrosamine content.

52. A method, as claimed in claim 46, wherein:

said first exposing step comprises drying said tobacco to a moisture content of no more than about 35%.

53. A method, as claimed in claim 52, wherein:

said second exposing step comprises drying said tobacco to a moisture content of no more than about 16%.

54. A method, as claimed in claim 53, further comprising:

after said second exposing step, a third exposing step of exposing said tobacco to ambient air for a time sufficient to increase said moisture content of said tobacco relative to said moisture content of said tobacco upon completion of said second exposing step.

55. A method, as claimed in claim 54, wherein:

said tobacco comprises a moisture content of between about 20% and about 25% after said third exposing step.

56. A method, as claimed in claim 46, wherein:

said first exposing step is initiated while said harvested tobacco is at least one of green, yellow, and a combination thereof.

57. A method, as claimed in claim 46, further comprising:

avoiding an application of nitrogen-containing fertilizer to said tobacco prior to a harvesting of said tobacco.

58. A method, as claimed in claim 57, wherein:

said tobacco comprises a dry nitrosamine content of no more than about 1 ppm upon completion of said first exposing step.

59. A method, as claimed in claim 58, wherein:

said tobacco comprises a dry nitrosamine content of no more than about 0.75 ppm after said second exposing step.

* * * * *